US005462832A

United States Patent [19]

Iwasaki

[11] Patent Number: 5,462,832

[45] Date of Patent: Oct. 31, 1995

[54] METHOD OF FORMING RADIATION IMAGES AND SILVER HALIDE PHOTOGRAPHIC MATERIAL THEREFOR

[75] Inventor: Nobuyuki Iwasaki, Kanagawa, Japan

[73] Assignee: Fuji Photo Film Co., Ltd., Kanagawa, Japan

[21] Appl. No.: 274,025

[22] Filed: Jul. 12, 1994

[30] Foreign Application Priority Data

Jul. 14, 1993 [JP] Japan ..... 5-174384

[51] Int. Cl.[6] ..... G03C 5/16

[52] U.S. Cl. ..... 430/139; 430/502; 430/967; 430/510; 430/572; 430/435

[58] Field of Search ..... 430/139, 502, 430/967, 510, 572, 435

[56] References Cited

U.S. PATENT DOCUMENTS

| | | | |
|---|---|---|---|
| 4,639,417 | 1/1987 | Honda et al. | 430/567 |
| 4,689,292 | 8/1987 | Metoki et al. . | |
| 4,803,150 | 2/1989 | Dickerson et al. | 430/502 |
| 5,108,881 | 4/1992 | Dickerson et al. | 430/502 |
| 5,238,795 | 8/1993 | Metoki | 430/502 |
| 5,268,251 | 12/1993 | Sakuma | 430/139 |

FOREIGN PATENT DOCUMENTS

| | | | |
|---|---|---|---|
| 0501423 | 9/1992 | European Pat. Off. | 430/502 |

*Primary Examiner*—Thomas R. Neville
*Attorney, Agent, or Firm*—Sughrue, Mion, Zinn, Macpeak & Seas

[57] ABSTRACT

A novel method of forming radiation images, especially X-ray images of bones and gastric areas for medical examination, is disclosed. The method comprises the steps of exposing a radiation image-forming system to radiation, the radiation image-forming system comprising a silver halide photographic material having at least one light-sensitive silver halide emulsion layer on each side of a transparent support and two radiation-intensifying screens respectively arranged on the front and the back sides of the photographic material, the photographic material having a crossover rate of at most 15% with respect to the light emitted from the intensifying screens; and developing the exposed photographic material to form a radiation image, wherein the developed photographic material has a characteristic curve such that when drawn using crossed coordinates equal to each other in unit length, with diffusion density as ordinate (Y-axis) and common logarithm of exposure amount as abscissa (X-axis), the characteristic curve provides a point gamma value ranging from 1.8 to 3.0 at every point within the optical density range of 0.7 to 1.5 and a point gamma value ranging from 1.2 to 2.0 at every point within the optical density range of 2.0 to 2.8. The X-ray images formed by the method have a good balance between the image quality and the sensitivity.

13 Claims, 1 Drawing Sheet

FIGURE
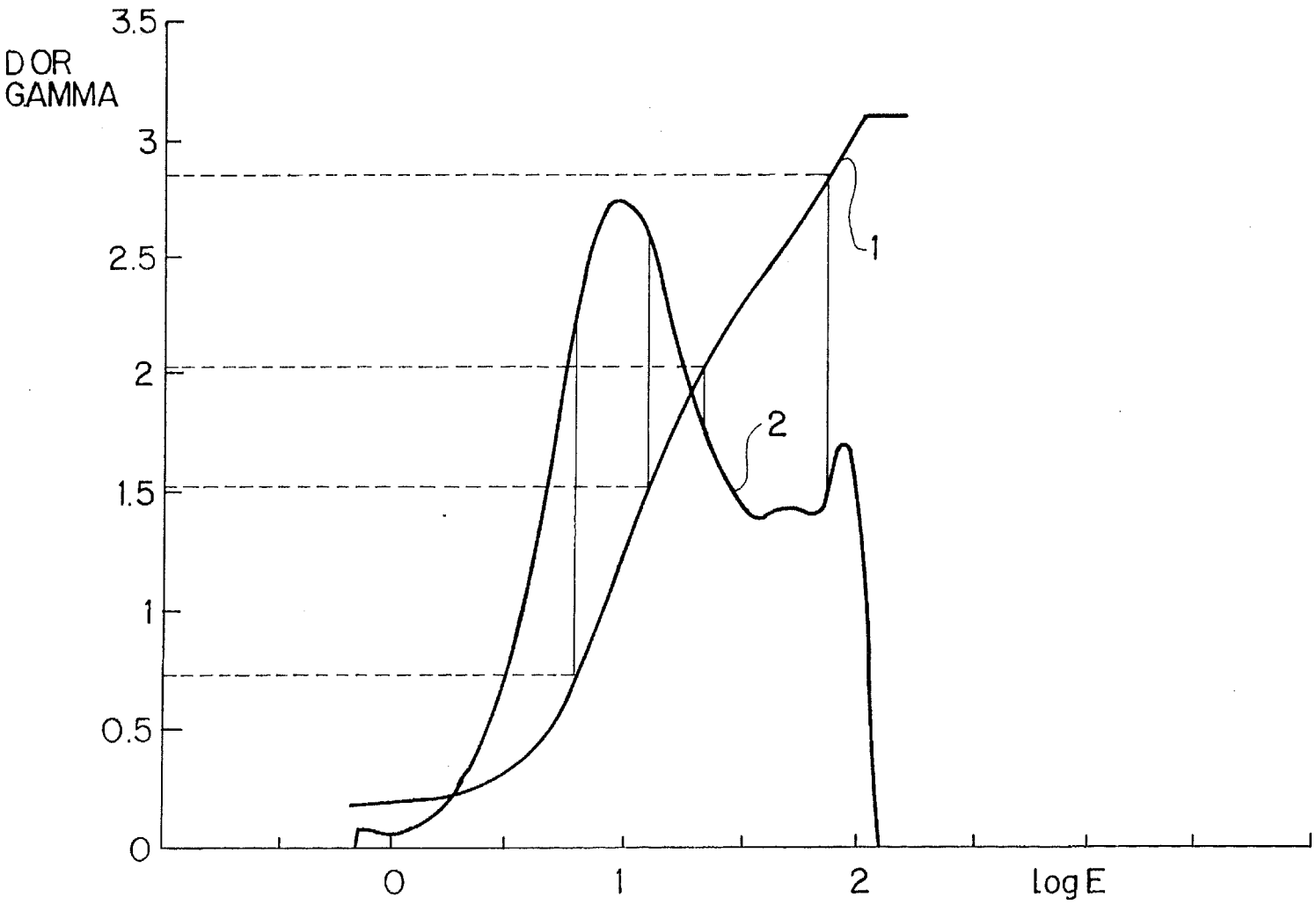

METHOD OF FORMING RADIATION IMAGES AND SILVER HALIDE PHOTOGRAPHIC MATERIAL THEREFOR

FIELD OF THE INVENTION

The present invention relates to a novel silver halide photographic material and to a method of forming an X-ray image. In particular, the present invention is concerned with a silver halide photographic material which can provide an image of excellent quality in the field of X-ray photography for the bones and gastric areas and with a method for forming said image.

BACKGROUND OF THE INVENTION

In medical radiography, the image of affected tissue of a patient is formed by recording the pattern of X rays transmitted by the tissue in a photosensitive material which comprises a transparent support having thereon at least one light-sensitive silver halide emulsion layer (i.e., a silver halide photographic material). A transmission pattern of X rays can be recorded by using a silver halide photographic material alone. However, it is undesirable for the human body to be exposed to X rays in quantity, so that a combination of a silver halide photographic material with a radiation intensifying screen is generally used in practicing X-ray photography. The radiation intensifying screen comprises a support having a phosphor layer provided thereon, and the phosphor layer functions so as to convert the X rays absorbed thereby to visible rays to which a silver halide photographic material has high sensitivity. Therefore, the intensifying screen can markedly improve the sensitivity of an X-ray photograph taking system.

For the purpose of further heightening the sensitivity of an X-ray photograph taking system, there was developed the method of using a both-sided emulsion film, or a silver halide photographic material having silver halide light-sensitive emulsion layers on front and back sides of a support respectively, and practicing X-ray photography in a condition such that the film is inserted between two radiation intensifying screens (which may be simply called "intensifying screen"). In ordinary X-ray photography, the above-described photograph taking method is adopted at present. The development of this method originated in that sufficient X-ray absorption was not achieved by the use of only one intensifying screen. More specifically, even if the amount of a phosphor contained in one intensifying screen is increased, the converted visible rays are scattered and reflected inside the phosphor layer since the increased content of the phosphor results in thickening the phosphor layer. Accordingly, the visible rays emitted from the intensifying screen strike divergently on the surface of the photosensitive material disposed in contact with the intensifying screen. In addition, the visible rays generating in the depth of the phosphor layer are hard to get out of the phosphor layer. Thus, the amount of effective visible rays emitted from the intensifying screen cannot be increased even if the thickness of the phosphor layer is increased excessively. On the other hand, the X-ray photograph taking method using two intensifying screens which each contain a phosphor layer having a moderate thickness has an advantage in that the X-ray absorption as a whole can be increased and effectively converted visible rays can be taken out of the intensifying screens.

The research for finding out an X-ray photograph taking system excellent in balance between image quality and photographic speed has so far been carried out continuously.

For instance, there has been prevailingly used the combination of a blue light-emitting intensifying screen having a layer containing calcium tungstate as a phosphor with a spectrally unsensitized silver halide photographic material (e.g., the combination of Hi-Screen Standard and RX, both being the products of Fuji Photo Film Co., Ltd.). In recent years, however, the combination of a green light-emitting intensifying screen having a layer containing the terbium-activated oxysulfide of a rare earth element as a phosphor with an orthochromatically sensitized silver halide photographic material (e.g., the combination of Grenex 4 with RXO, both being the products of Fuji Photo Film Co., Ltd.) has come to be used, and has effected improvements in both sensitivity and image quality.

However, a silver halide photographic material provided with photographic emulsion layers on both sides has a problem of tending to suffer deterioration in image quality due to crossover rays. The term "crossover rays" used herein refers to the visible rays which are emitted from each of the intensifying screens arranged on both sides of a photosensitive material, are transmitted by the support (usually having a thickness of 170–180 μm or so) of the photosensitive material and further reach the light-sensitive layer disposed on the opposite side, thereby causing deterioration in image qualities (especially sharpness).

For the purpose of reducing the above-described crossover rays, various arts have so far been developed. For instance, U.S. Pat. Nos. 4,425,425 and 4,425,426 disclose the arts of using spectrally sensitized tabular-grain emulsions having high aspect ratios as light-sensitive silver halide photographic emulsions. According to those inventions, it is possible to reduce the crossover rays to 15–22%. Moreover, U.S. Pat. No. 4,803,150 discloses the art of disposing a layer of a microcrystalline dye capable of being decolored by development-processing between the support and the light-sensitive layer of a silver halide photographic material. Such an invention enables the crossover rays to be reduced to below 10%.

On the other hand, there have been made attempts to find out X-ray photograph taking systems excellent in balance between image quality and photographic speed by combining a silver halide photographic material having photographic emulsions on both sides thereof with radiation intensifying screens under specified conditions. For instance, JP-A-02- 266344 (the term "JP-A" as used herein means an "unexamined published Japanese patent application"), JP-A-02-297544 and U.S. Pat. No. 4,803,150 disclose the X-ray photographing systems designed so that the combination of an intensifying screen arranged on the X-ray irradiation side (front intensifying screen) with a light-sensitive layer (front sensitive layer) may be different in spectral characteristic (sensitivity) from the combination of an intensifying screen arranged on the opposite side (back intensifying screen) with a light-sensitive layer (back sensitive layer) and, what is more, the front combination and the back combination may have different contrasts. Further, experimental results of the combinations of the products of 3M Co., Ltd. concerning silver halide photographic materials and radiation intensifying screens are reported in *Photographic Science and Engineering, Vol.* 26, No. 1, p. 40 (1982). More specifically, the report states that the combination of Trimax 12 (trade name, a commercial intensifying screen of 3M Co.) with XUD (trade name, a commercial silver halide photographic material of 3M Co.) is almost equal in sensitivity and sharpness (MTF) to the combination of Trimax 4 (trade name, a commercial intensifying screen of 3M Co.) with XD (trade name, a commercial silver halide photographic material), but the former combination is higher in NEQ (ratio of noise to output signal) than the latter. Further, the report teaches that the above-described results can be inferred from the fact that XUD shows higher sharpness than XD, while Trimax 12 shows higher X-ray absorption than Trimax 4.

If attention is devoted only to the quality of X-ray images, it goes without saying that high quality images can be obtained by the combined use of a low-sensitivity silver halide photographic material and low-sensitivity radiation intensifying screens. In using a low-sensitivity combination as described above, however, it becomes indispensable to increase an amount of X rays to which human body is exposed (exposure amount). Consequently, such a combination is undesirable for practical use. In the case of a mass examination in particular, wherein most of the subjects are healthy persons, it is impossible to use that combination in practice because it is necessary to strictly avoid an increase in exposure amount.

As mentioned above, various studies have heretofore been made so as to develop X-ray photographic systems excellent in the balance between the image quality and the sensitivity in various kinds of radiographic systems. However, the conventional methods for forming X-ray images that have heretofore been developed for medical X-ray photography for obtaining X-ray images of bones and gastric areas of human bodies could not still be said to be X-ray photographic systems satisfying both the high image quality and the high sensitivity. This is because it is extremely important to clearly observe the fine structure of a bone so as to medically examine the bone by means of the X-ray image of the bone and it is also extremely important to clearly observe the structure of the gastric wall so as to medically examine the gastric area by means of the double-contrast X-ray image of the gastric area. However, the conventional methods for forming X-ray images for medical examinations were not satisfactory in view of these requirements.

In addition, X-ray photography for forming X-ray images of bones and gastric areas involves other difficulties. In forming X-ray images of bones by radiography for medical examinations, it is necessary that both the bones through which a small amount of X-ray penetrates and the soft tissues therearound through which a large amount of X-ray penetrates are photographed to have densities satisfactory for easy examination by medical examiners. For this, if a soft contrast photographic system is employed, the image formed will be examined with ease as a whole but the fine structure of the photographed bone is difficult to observe and examine. On the contrary, if a hard contrast photographic system is employed, the fine structure of the photographed bone will be clear but the soft tissues around the bone are defaced to dark in the photographed image so that they could not almost be observed or examined with an ordinary Schaukasten (film viewer). Medical examinations of gastric areas by double-contrast radiography have the same problems. It is difficult to observe and examine both the fine structure of the gastric wall to which a contrast medium of barium salts has been adhered and the inside of the upper area of the stomach filled with gas (gastric bubble) by means of one X-ray photographic image obtained by double-contrast radiography. This is because the amount of X-ray transmission noticeably varies in the different parts and areas of a stomach and therefore medical radiography for forming X-ray images of gastric areas needs a broad latitude, while the fine structures of gastric areas must be clearly observed and examined. It is extremely difficult to satisfy all the necessary requirements in medical radiography.

SUMMARY OF THE INVENTION

The essential object of the present invention is to provide a novel silver halide photographic material constituting a novel X-ray photographic system excellent in the balance between the image quality and the sensitivity.

In particular, the object of the present invention is to provide a novel silver halide photographic material constituting an excellent novel X-ray photographic system for photographing bones and gastric areas.

The object of the present invention is also to provide an X-ray photographic method for obtaining satisfactory X-ray images, using a combination of the novel silver halide photographic material and radiation-intensifying screens.

We, the present inventors assiduously studied and, as a results, have attained the objects of the present invention by a method of forming radiation images comprising the steps of:

exposing a radiation image-forming system to radiation, said radiation image-forming system comprising a silver halide photographic material having at least one light-sensitive silver halide emulsion layer on each side of a transparent support and two radiation-intensifying screens respectively arranged on the front and the back sides of said photographic material, said photographic material having a crossover rate of at most 15% with respect to the light emitted from said intensifying screens; and developing said exposed photographic material to form a radiation image, wherein said developed photographic material has a characteristic curve such that when drawn using crossed coordinates equal to each other in unit length, with diffusion density as ordinate (Y-axis) and common logarithm of exposure amount as abscissa (X-axis), the characteristic curve provides a point gamma value ranging from 1.8 to 3.0 at every point within the optical density range of 0.7 to 1.5 and a point gamma value ranging from 1.2 to 2.0 at every point within the optical density range of 2.0 to 2.8.

We also have attained the objects of the present invention by a silver halide photographic material which has at least one light-sensitive silver halide emulsion layer on each side of a transparent support and constitutes a radiation image-forming system comprising two radiation-intensifying screens respectively arranged on the front and the back sides of the photographic material; said photographic material having a crossover rate of at most 15% with respect to the light emitted from said intensifying screens; and when sandwiched between said two intensifying screens, subjected to exposure to the same quantity of a monochromatic light having the same wavelength as that of the main emission peak of the radiation-intensifying screens and a half-width of 20±5 nm, through a step-wedge, and then developed with Developer (I) having the following composition at a developer temperature of 35° C. for a development time of 25 seconds, said photographic material producing an image having a characteristic curve such that when drawn using crossed coordinates equal to each other in unit length, with diffusion density as ordinate (Y-axis) and common logarithm of exposure amount as abscissa (X-axis), the characteristic curve provides a point gamma value ranging from 1.8 to 3.0 at every point within the optical density range of 0.7 to 1.5 and a point gamma value ranging from 1.2 to 2.0 at every point within the optical density range of 2.0 to 2.8:

| Composition of Developer (I) | |
|---|---|
| Potassium hydroxide | 21 g |
| Potassium sulfite | 63 g |
| Boric acid | 10 g |
| Hydroquinone | 25 g |
| Triethylene glycol | 20 g |
| 5-Nitroindazole | 0.2 g |
| Glacial acetic acid | 10 g |
| 1-Phenyl-3-pyrazolidone | 1.2 g |
| 5-Methylbenzotriazole | 0.05 g |
| Glutaraldehyde | 5 g |
| Potassium bromide | 4 g |
| Water to make | 1 l |
| pH adjusted to | 10.02 |

BRIEF DESCRIPTION OF THE DRAWING

FIGURE illustrates a characteristic curve of a photographic light-sensitive material prepared in accordance with an embodiment of the present invention. Therein, a curve connecting point gamma values at individual points on the characteristic curve (gamma curve) is also shown.

In FIGURE, the exposure amount (log E) is plotted as abscissa and the optical density or the gamma value as ordinate, and numeral 1 indicates the characteristic curve and numeral 2 the gamma curve.

DETAILED DESCRIPTION OF THE INVENTION

The term "crossover" used herein means the rays which are some portion of the rays incident upon one emulsion layer of a photographic material having light-sensitive emulsions coated on both sides of a transparent support, and correspond to those transmitted by said emulsion layer and the support to sensitize the other emulsion layer on the opposite side. The crossover rate (%) can be determined by the method disclosed by U.S. Pat. No. 4,425,425 to Abbott et al. Specifically, black paper, a photosensitive material having substantially the same light-sensitive layers on both sides and a intensifying screen are superposed upon one another, in that order starting from the X-ray source, packed in a cassette for X-ray photography, and exposed stepwise to X rays. After development, the photosensitive material is divided into two pieces, only the light-sensitive layer which has been in contact with the intensifying screen is left in one piece and the image formed therein is examined for characteristic curve. In the other piece, on the other hand, only the light-sensitive layer on the opposite side is left and the image formed therein is examined for characteristic curve. Thus, the crossover rate (%) is defined as follows, with a difference in sensitivity between these two characteristic curves in the density region corresponding to the nearly linear portion being taken as $^{\Delta}$ logE:

Crossover rate (%)=100/(anti log ($^{\Delta}$ log E)+1)

The lower the crossover rate of a photographic material is, the sharper image the material can form. Various methods of reducing crossover are known. The most desirable method consists in fixation of a dye of the type which can be decolored by development between a support and a light-sensitive material. The microcrystalline dyes taught by U.S. Pat. No. 4,803,150 have great advantage in reducing crossover because they can be fixed to a satisfactory extent, decolored completely, and contained in quantities. According to such a method, not only desensitization due to unsatisfactory fixation does not occur, but also the dyes can be decolored even by 90-second development and the crossover rate can be reduced to at most 15%.

As for the dye layer provided for reducing crossover, a layer having the highest possible dye density is favored. Further, it is desirable that the coverage of gelatin used as binder in the dye layer be reduced and the thickness of the dye layer be set at 0.5 μm or less. However, when the dye layer is rendered too thin, it tends to cause a poor adhesion trouble. Therefore, the most suitable thickness of the dye layer ranges from 0.05 to 0.3 μm.

According to the image forming method of the present invention which uses a photographic material having the particular characteristic curve defined by the present invention, it is possible to form medical images of bones and gastric areas, from which the photographed bones and gastric areas are easily examined. The photographic material of the present invention gives a relatively high contrast image having a point gamma falling within the range of from 1.8 to 3.0 in the density area of from 0.7 to 1.5. Therefore, the image of bones formed on the material may have a satisfactory contrast within the low-density range to the middle-density range to clearly show the trabeculae of bone. In addition, since the point gamma in the density area of from 2.0 to 2.8 is lowered to fall from 1.2 to 2.0, the latitude in the high-density range is broadened so that the soft tissues around bones are not defaced to dark. Accordingly, both the bone structure and the soft tissues around bones may be medically observed and examined in one photograph.

The image of gastric areas formed according to the method of the present invention does not also have any dark defaced areas but clearly shows even the fine structure of the wall of the stomach. From the image, therefore, medical examination of even the fine structure of the gastric wall is possible.

The term "point gamma" used in the present invention is defined as follows: At a given point on a characteristic curve, which is drawn using crossed coordinates equal to each other in unit length, with diffusion density as ordinate (Y-axis) and common logarithm of exposure amount as abscissa (X-axis), the tangent is drawn and the slope thereof is defined as point gamma. That is, when the angle the tangent forms with the X-axis is θ the point gamma is represented by tanθ. The characteristic curve according to the present invention and the differential curve thereof are shown in FIGURE.

The standard condition for photographic processing using Developer (I) is described below in detail.

Development time: 25 seconds (21 seconds inside the developer + 4 seconds outside the developer)

Fixation time: 20 seconds (16 seconds inside the fixer having the following composition + 4 seconds outside the fixer)

Washing time: 12 seconds

Squeeze and Drying: 26 seconds

Developing Machine: A commercial model of roller conveyable type automatic developing machine (e.g., Auto Processor Model FPM-5000, made by Fuji Photo Film Co., Ltd.) equipped with a developing tank having a volume of 22 l and a developer temperature of 35° C. and a fixing tank having a volume of 15.5 l and a fixer temperature of 25° C. As another commercial model of automatic developing machine of the same type as described above, Auto Processor Model M-6AW, made by Eastman Kodak Co., Ltd., is instanced.

| Composition of Fixer (Fixer F): | |
|---|---|
| Ammonium thiosulfate (70% weight/volume) | 200 ml |
| Sodium sulfite | 20 g |
| Boric acid | 8 g |
| Disodium ethylenediaminetetraacetate (dihydrate) | 0.1 g |
| Aluminum sulfate | 15 g |
| Sulfuric acid | 2 g |
| Glacial acetic acid | 22 g |
| Water to make | 1 l |

Fixer F is adjusted to pH 4.5 using sodium hydroxide or glacial acetic acid, if needed.

Any methods may be employed to obtain photographic materials having the characteristic curve defined by the present invention. One example will be mentioned below.

Two emulsions each having a different sensitivity are selected. The difference in the sensitivity between the two desirably falls within the range of from 1:0.1 to 1:0.4. The two emulsions may be coated on a support as a mixture of them or may be coated thereon as different layers. Most preferably, one emulsion having a higher sensitivity is coated as an upper layer while the other emulsion having a lower sensitivity is coated as a lower layer. Regarding the ratio of the emulsions, the ratio of the low-sensitivity emulsion is from 0.7 to 0.1, more preferably from 0.5 to 0.2, as silver, to the high-sensitivity emulsion of being 1 (one).

A representative of the silver halide photographic materials in accordance with the present invention has a construction such that a subbing layer, a dye layer for reduction of crossover, at least one light-sensitive silver halide emulsion layer and a protective layer are formed in that order on each of the front and back sides of a blue-colored transparent support. Preferably, every couple of corresponding layers formed on both sides are substantially the same as each other.

The support is made from a transparent material such as polyethylene terephthalate, and colored with a blue dye. As for the blue dye, various kinds of dyes including anthraquinone dyes known as the dyes for coloring X-ray photographic films can be used. The thickness of the support can be properly chosen from the range of 160 to 200 μm.

On the support, in analogy with conventional X-ray photographic films, a subbing layer comprising a water-soluble high molecular substance such as gelatin is provided.

On the subbing layer, a dye layer for reduction of crossover is provided. The dye layer is generally formed as a dye-containing colloid layer, and it is desirable that the dye layer be decolored by the development-processing defined above. Further, it is desirable that the dye be fixed to the bottom of the dye layer so as not to diffuse into the upper layers including a light-sensitive silver halide emulsion layer and a protective layer.

On the dye layer, a light-sensitive silver halide emulsion layer is formed. Light-sensitive silver halide emulsions used in the photosensitive material of the present invention can be prepared in known manners.

In addition, it is required of the photosensitive material to have sensitivity to an intensifying screen used together therewith. Since ordinary silver halide emulsions have their sensitivities to light of wavelengths ranging from those of blue rays to those of ultraviolet rays, the foregoing point can be left out of consideration in so far as the wavelengths of rays emitted from the intensifying screen are within the wavelength region of blue to ultraviolet rays (e.g., as in the case of using an intensifying screen containing as phosphor a calcium tungstate phosphor). However, when an intensifying screen using, e.g., a terbium-activated gadolinium oxysulfide phosphor emitting rays having their main wavelength at 545 nm is employed, spectral sensitization in the green region is required of the silver halide grains contained in the photosensitive material.

Silver halide emulsions which can be preferably used in the silver halide photographic material of the present invention are emulsions containing tabular silver halide grains. This is because the emulsions containing tabular silver halide grains have advantages in that they are well balanced between sensitivity and granularity, have excellent spectral sensitization characteristics and great ability to reduce crossover, and so on.

In recent years, various improvements have been introduced in the methods of preparing an emulsion containing tabular silver halide grains. Those arts of improving the preparation methods can be also adopted in preparing tabular-form silver halide emulsion grains used for producing the silver halide photographic material of the present invention. Specific examples of such arts include the art of improving the pressure characteristics of tabular silver halide grains by combining reduction sensitization with the addition of a mercapto compound or a certain dye, the art of sensitizing tabular silver halide grains with a selenium compound, the art of reducing the pressure mark generating upon roller conveyance by decreasing an iodide content in surface part of the individual grains, and the art of improving the balance between the reduction in pressure mark upon roller conveyance and drying characteristics by adjusting the silver/gelatin ratio in each layer to a most appropriate value when the photographic material has a double-layer emulsion structure. The above-cited arts are disclosed in JP-A-4-344635, JP-A-5-45754, JP-A-3-288145, JP-A-4-163447, JP-A-4-107442 and JP-A-4-311949.

As described above, it is desirable that the dye layer which is a constituent layer of the present silver halide photographic material be decolored under the aforementioned development condition. In order to carry out this purpose, it is advantageous to decrease the amount of a binder used in the light-sensitive layer disposed on the dye layer. Specifically, it is desirable to control the binder content in the light-sensitive layer 5 g/m$^2$ or less, preferably 3 g/m$^2$ or less. On the other hand, the content of silver in the light-sensitive layer is preferably adjusted to at most 3 g/m$^2$, particularly at most 2 g/m$^2$.

On the laminate thus formed on each side of a support, including a subbing layer and a light-sensitive layer, a protective layer comprising a water-soluble high molecular substance, such as gelatin, is provided in a conventional manner, thereby obtaining the silver halide photographic material of the present invention.

The silver halide photographic material according to the present invention does not have any particular limitation as to the emulsion sensitization method, additives and ingredients used for the preparation thereof, the photographic processing method to which it is subjected. For instance, various arts as described in JP-A-02-68539, JP-A-02-103037 and JP-A-02-115837 can be used, which are summarized below with pages on which they are specifically described.

| Item | Reference |
|---|---|
| 1. Chemical sensitization | JP-A-02-68539, page 10, from right upper column, line 13, to left lower column, line 16. |
| 2. Antifoggant, Stabilizer | JP-A-02-68539, from page 10, left lower column, line 17, to page 11, left upper column, line 7, and from page 3, left lower column, line 2, to page 4, left lower column. |
| 3. Spectral sensitizing dye | JP-A-02-68539, from page 4, right lower column, line 4, to page 8, right lower column. |
| 4. Surfactant, Antistatic agent | JP-A-02-68539, from page 11, left upper column, line 14, to page 12, left upper column, line 9. |
| 5. Matting agent, Lubricant, Plasticizer | JP-A-02-68539, page 12, from left upper column, line 10, to right upper column, line 10, and page 14, from left lower column, line 10, to right lower column, line 1. |
| 6. Hydrophilic colloid | JP-A-02-68539, page 12, from right upper column, line 11, to left lower column, line 16. |
| 7. Hardener | JP-A-02-68539, from page 12, left lower column, line 17, to page 13, right upper column, line 6. |
| 8. Support | JP-A-02-68539, page 13, right upper column, from line 7 to line 20. |
| 9. Dye, Mordant | JP-A-02-68539, from page 13, left lower column, line 1, to page 14, left lower column, line 9. |
| 10. Photographic processing | JP-A-02-103037, from page 16, right upper column, line 7, to page 19, left lower column, line 15, and JP-A-02-115837, from page 3, right lower column, line 5, to page 6, right upper column, line 10. |

Further, preferred embodiments of the present invention are described in detail.

It has proved that good image quality and satisfactory photographic speed can be obtained when the silver halide photographic material having a novel characteristic curve defined by the present invention and a reduced crossover rate possesses its sensitivity in a specified range and is used for image formation in combination with intensifying screens of the kind which have high sensitivity and relatively good contrast transfer function (CTF), namely the CTF value of at least 0.79 at a spacial frequency of 1 cycle/mm and the CTF value of at least 0.36 at a spacial frequency of 3 cycles/mm.

That is, although a photographic material and intensifying screens may be arbitrarily combined, more improved balance can be acquired between the image quality and the photographic speed when the combination satisfying the above-described sensitivity and contrast requirements is adopted. On the condition that the photographic speed of the combined system is constant, when high-sensitivity intensifying screens which can absorb X rays in considerable quantities are used in combination with a photosensitive material of low sensitivity, the image obtained is very excellent in granularity but quite inferior in sharpness. Even when the photosensitive material used in the above case has high sharpness, the image obtained does not have satisfactory sharpness and cannot be a desirable X-ray image from the diagnostic point of view. Conversely, when low-sensitivity intensifying screens having poor X-ray absorption are used in combination with a photosensitive material of standard or high sensitivity, an X-ray image of high sharpness can be obtained, but the image suffers from deterioration of granularity. In this case also, therefore, the X-ray image obtained is undesirable from the viewpoint of diagnosis. The best combination is obtained by combining intensifying screens of the kind which have relatively high sensitivity such that they have X-ray absorption of at least 25% when irradiated with the X rays of 80 KVp and have CTF values of at least 0.79 at a spacial frequency of 1 cycle/mm and at least 0.36 at a spacial frequency of 3 cycles/mm with a photosensitive material having a sensitivity reduced to such an extent that the high sensitivity characteristics of the intensifying screens can be canceled out by the sensitivity reduction of the photosensitive material.

According to our study, it proved that most suitable sensitivity distribution in the combined system of a silver halide photographic material and radiation intensifying screens depends on the photographic speed level of the combined system, the size of a subject for diagnosis and so on. As a result of further study, however, we have found that an X-ray image of high quality can be obtained with sufficiently high photographic speed when a photosensitive material having moderate sensitivity is used in combination with intensifying screens in which the content of a phosphor is increased to such an extent that it is possible to keep allowable level of sharpness in order to increase the amount of X rays absorbed thereby, and which are designed so as to exhibit high contrast transfer function (CTF) values.

In the meantime, the preferred level of sharpness depends on the size of a subject for diagnosis. In making clinical evaluation of thorax, the contrast transfer function values at spacial frequencies ranging from 0.5 cycle/mm to 3 cycles/mm are important when the evaluation is expressed in terms of contrast transfer function (CTF) as a physical quantity. More specifically, it is required that the value of contrast transfer function at the spacial frequency of 1 cycle/mm is at least 0.65 and that at the spacial frequency of 2 cycles/mm is at least 0.22. In addition, there are restrictions as to the photographic speed of the combined system. This is because if the system having high photographic speed as a whole is chosen, image quality high enough to diagnose thorax or the like cannot be obtained even if the system is composed so as to acquire the most desirable balance. Conversely, the system of low photographic speed is undesirable because it creates an X-ray exposure problem.

The expression "specific sensitivity range which favors the silver halide photographic material" refers to the sensitivity range requiring the exposure amount ranging from 0.010 lux.sec to 0.035 lux.sec, preferably 0.012 to 0.030 lux.sec to provide the density of minimum density plus 0.5 for the light-sensitive layer disposed on the exposure side when the photographic material is exposed to monochromatic light having the same wavelength as that of the main emission peak of the radiation intensifying screens and a half width of 20±5 nm, developed with Developer (I) described hereinbefore under a condition that a developer temperature is regulated at 35° C. and a development time is set at 25 seconds, and examined for the image density after the light-sensitive layer disposed on the side opposite to the exposure side is removed therefrom.

The sensitivities set within the above-described range are lower than the sensitivities of commercially available X-ray films, such as Roentgen Film Super HRS, products of Fuji Photo Film Co., Ltd.

In measuring the sensitivity of the silver halide photographic material, it is necessary to use the exposure light source whose wavelength coincides with or almost coincides with the wavelength of the main emission peak of the radiation intensifying screens used in combination with the photographic material. For instance, when the phosphor of the radiation intensifying screen is terbium-activated gadolinium oxysulfide, the wavelength of the main emission peak thereof is 545 nm. Accordingly, a light source used in measuring the sensitivity of the silver halide photographic material is one which can emit light of wavelengths centering at 545 nm.

In order to obtain monochromatic light, a method of using a filter system constituted of a light source and interference filter(s) can be adopted. According to this method, though the intensity and the half width of monochromatic light depend on what kinds of interference filters are combined with a light source, monochromatic light having intensity high enough to provide the required amount of exposure and a half width of 20±5 nm can be generally obtained with ease. Additionally, the silver halide photographic material shows a continuous spectrum with respect to its spectral sensitivities, irrespective of its being spectrally sensitized or not. Therefore, it can be said that the sensitivities are substantially constant in the wavelength range of 20±5 nm.

As an example of an exposure light source, the system constituted of a tungsten light source (color temperature: 2856° K) and a transmitting filter having a transmission peak at the wavelength of 545 nm and a half width of 20 nm can be used when the phosphor in the radiation intensifying screen used in combination with the photographic material is terbium-activated gadolinium oxysulfide.

Then, radiation intensifying screens which can be used to advantage in the present invention are illustrated in detail.

The radiation intensifying screens used in the combined system of the present invention can be easily obtained by designing so as to acquire the sensitivity defined by the present invention and carrying out the preparation thereof according to conventional arts of preparing radiation intensifying screens. Specific examples of intensifying screens are described in *Research Disclosure,* Item 18431, Section IX.

The radiation intensifying screen is basically constituted of a support and a phosphor layer formed on one side thereof. The phosphor layer is a layer containing a phosphor dispersed in a binder. In addition, a transparent protective layer is generally provided on the surface of the phosphor layer (the side opposite to the support) to protect the phosphor layer from chemical change in quality and physical impact.

Phosphors which can be preferably used for the radiation intensifying screens in the present invention are represented by the following general formula:

$$M_{(w-n)}M'_nO_wX$$

wherein M represents at least one metal selected from a group consisting of yttrium, lanthanum, gadolinium and lutetium; M' represents at least one rare earth element, preferably dysprosium, erbium, europium, holmium, neodymium, praseodymium, samarium, cerium, terbium, thulium or ytterbium; X represents an intermediate chalcogen (S, Se or Te) or a halogen; n is a numerical value ranging from 0.0002 to 0.2; and w is 1 when X is a halogen, while it is 2 when X is a chalcogen.

Specific examples of a radiation intensifying phosphor which can be preferably used in the radiation intensifying screens of the present invention include terbium-activated rare earth metal oxysulfide type phosphors [e.g., $Y_2O_2S$:Tb, $Gd_2O_2S$:Tb, $La_2O_2S$:Tb, $(Y,Gd)_{202}S$:Tb, $(Y,Gd)_2O_2S$:Tb, Tm], terbium-activated rare earth element oxyhalogenide type phosphors [e.g., LaOBr:Tb, LaOBr:Tb,Tm, LaOCl:Tb, LaOCl:Tb, LaOCl:Tb,Tm, GdOBr:Tb, GdOCl:Tb] and thulium-activated rare earth element oxyhalogenide type phosphors [e.g., LaOBr:Tm, LaOCl:Tm).

Of these phosphors, terbium-activated gadolinium oxysulfide type phosphor is particularly preferred as a phosphor for the radiation intensifying screens used in the present invention. The phosphor of the foregoing type is described in detail in U.S. Pat. No. 3,725,704.

The phosphor layer is generally provided on a support under ordinary pressure using a coating method as described below. Specifically, the phosphor layer is formed in a manner such that granulated phosphor and a binder are mixed and dispersed in an appropriate solvent to prepare a dispersion, the dispersion prepared is directly applied to a support for radiation intensifying screen using a coating means, such as a doctor blade, a roll coater, a knife coater, etc., under ordinary pressure, and then the solvent is removed from the coating. In another manner, the foregoing dispersion is coated in advance on a temporary support, such as a glass plate, under ordinary pressure, the solvent is removed from the coating to form a thin film of phosphor-containing resin, and then the thin film is peeled apart from the temporary support and bonded to the support for a radiation intensifying screen.

In preparing the radiation intensifying screens used in the present invention, though a conventional manner as described above can be adopted, it is preferable to use a thermoplastic elastomer as a binder and to undergo a compressive stressing treatment in order to heighten the packing rate of a phosphor (that is, to lessen the voids in the phosphor layer).

The sensitivity of the radiation intensifying screen depends basically upon the total amount of emission from the phosphor contained in the panel, and the total amount of emission depends upon not only the emission luminance of the phosphor itself but also the phosphor content in the phosphor layer. A high phosphor content means that a large amount of radiation, such as X rays, can be absorbed by the phosphor. Therefore, the higher the phosphor content, the higher sensitivity the intensifying screen can have, and at the same time it can contribute to improvements in image quality (especially in graininess). If the phosphor content in a phosphor layer is set at some definite value, on the other hand, relatively higher sharpness can be achieved the more densely the phosphor grains are packed. This is because denser packing of the phosphor grains can make the phosphor layer thinner, thereby reducing the divergence of emitted rays due to scattering phenomenon.

A suitable process of preparing the above-described type of radiation intensifying screens comprises:

(a) a step of forming a phosphor sheet containing a binder and a phosphor, and (b) a step of putting the foregoing phosphor sheet on a support and binding the sheet to the support as the sheet is compressively stressed at a temperature higher than the softening point or melting point of the binder.

Firstly the step (a) is illustrated.

A phosphor sheet which serves as the phosphor layer of a radiation intensifying screen can be prepared by coating a composition prepared by dispersing phosphor grains homogeneously into a binder solution on a temporary support for phosphor sheet formation, drying the composition coated, and then peeling it off the temporary support.

More specifically, a binder and phosphor grains are added to an appropriate organic solvent, and mixed with stirring to disperse the phosphor grains homogeneously into a binder solution. Thus, the coating composition is prepared.

As the binder, a thermoplastic elastomer having its softening or melting point in the temperature range of 30° C. to 150° C. can be used alone, or as a mixture with another binder polymer. Since thermoplastic elastomers have elasticity at ordinary temperature and come to have flowability by heating, they can protect the phosphor grains from being broken by pressure applied thereto upon compressive stressing. Specific examples of a thermoplastic elastomer include polystyrene, polyolefin, polyurethane, polyester, polyamide, polybutadiene, ethylene-vinyl acetate copolymer, polyvinyl chloride, natural rubber, fluororubber, polyisoprene, chlorinated polyethylene, styrene-butadiene rubber, silicone rubber and so on.

As for the proportion of a thermoplastic elastomer to the whole binder, the range of 10 to 100 wt % serves the purpose. However, it is preferable for the thermoplastic elastomer to constitute the highest possible percentage of the binder, especially 100 wt % of the binder.

Suitable examples of a solvent which can be used for preparing the coating composition include lower alcohols such as methanol, ethanol, n-propanol, n-butanol, etc.; chlorine-containing hydrocarbons such as methylene chloride, ethylene chloride, etc.; ketones such as acetone, methyl ethyl ketone, methyl isobutyl ketone, etc.; esters prepared from lower alcohols and lower fatty acids, such as methyl acetate, ethyl acetate, butyl acetate, etc.; ethers such as dioxane, ethylene glycol monoethyl ether, ethylene glycol monomethyl ether, etc.; and mixtures of two or more of the above-cited solvents.

A proper ratio between a binder and a phosphor in the coating composition depends on the characteristics required of the radiation intensifying screen to be made and the type of the phosphor. In general, however, the ratio between the binder and the phosphor is chosen from the range of 1:1 to 1:100 by weight, and particularly preferably from the range of 1:8 to 1:40 by weight.

In the coating composition, there may be added various additives including a dispersing agent for improving upon the dispersibility of the phosphor in the coating composition and a plasticizer for heightening the bonding strength between the binder and the phosphor in the phosphor layer formed. Specific examples of a dispersing agent used for the foregoing purpose include phthalic acid, stearic acid, caproic acid and oleophilic surfactants, and those of a plasticizer include phosphoric acid esters such as triphenyl phosphate, tricresyl phosphate, diphenyl phosphate, etc.; phthalic acid esters such as diethyl phthalate, dimethoxyethyl phthalate, etc.; glycolic acid esters such as ethyl phthalylethyl glycolate, butyl phthalylbutyl glycolate, etc.; and polyesters prepared from polyethylene glycol and aliphatic dibasic acids, such as polyester prepared from triethylene glycol and adipic acid, polyester prepared from diethylene glycol and succinic acid, etc.

The thus prepared coating composition containing the phosphor and the binder is then coated uniformly on the surface of a temporary support for sheet formation use. This coating operation can be carried out using a doctor blade, a roll coater, a knife coater or the like.

The temporary support can be arbitrarily chosen, e.g., from a glass plate, a metal plate and materials known to be usable as the support of radiation intensifying screens. Specific examples of a material for the temporary support include plastic films such as cellulose acetate film, polyester film, polyethylene terephthalate film, polyamide film, polyimide film, triacetate film, polycarbonate film, etc.; metal sheets such as aluminum foil, aluminum alloy foil, etc.; plain paper, baryta paper, resin-coated paper, pigment paper in which a pigment such as titanium oxide is incorporated, paper sized with polyvinyl alcohol or the like; and plates or sheets of ceramics, such as alumina, zirconia, magnesia, titania, etc.

The coating composition for formation of the phosphor layer is coated on the temporary support, dried and then peeled off the temporary support. Thus, a phosphor sheet to constitute the phosphor layer of a radiation intensifying screen is obtained. Accordingly, it is desirable that a surface lubricant be applied in advance to the surface of the temporary support, thereby making it easy to peel the phosphor sheet off the temporary support.

Then, the step (b) is described in detail.

Firstly, a support is arranged for the phosphor sheet formed in the above-described manner. This support can be chosen arbitrarily from the same materials as used in forming a phosphor sheet.

In preparing conventional radiation intensifying screens, it is known to apply a high molecular substance, such as gelatin, to a support as an adhesion providing layer on the side where a phosphor layer is to be provided for the purpose of strengthening the binding of a phosphor layer to a support, or to coat the surface of a support, on which a phosphor layer is to be provided, with a light reflecting layer containing a light reflecting substance such as titanium oxide or with a light absorbing layer containing a light absorbing substance such as carbon black in order to improve upon the sensitivity or the image qualities (sharpness, graininess) as radiation intensifying screen. Also on the support used in the present invention, those layers can be coated, and how to constitute and combine them can be properly chosen depending upon the purpose in using the radiation intensifying screen in the present invention.

The phosphor sheet obtained in the step (a) is superposed on a support, and then compressively stressed at a temperature higher than the softening or melting point of the binder used therein, thereby making the phosphor sheet adhere to the support.

By adopting the method of compressively stressing the phosphor sheet on the support without previous fixation, as in the above-described manner, the sheet can be spread out into a thinner sheet, the phosphor therein can be inhibited from suffering damage, and a higher packing rate of the phosphor can be achieved under the same pressure applied to the sheet in comparison with the case in which the sheet is pressed as it is fixed to the support. As for the device used in the present invention for the compressive stressing treatment, conventionally used devices such as a calender roll, a hot press and so on are suitable examples thereof. Specifically, the compressive stressing treatment using a calender roll is carried out by superposing the phosphor sheet obtained in the step (a) on the support and passing them at a constant speed between a pair of rollers heated up to a temperature higher than the softening or melting point of the binder. As for the compressive stressing device, those usable in the present invention should not be construed as being limited to the above-cited ones, but any devices which enable the compressive stressing of the sheet under heating can be used in the present invention.

Upon compressive stressing, it is desirable that the pressure of at least 50 kgw/cm$^2$ be imposed on the sheet.

In conventional radiation intensifying screens, a transparent protective film is provided on the surface of the phosphor layer, the reverse side of which is contact with the support, for the purpose of protecting the phosphor layer physically and chemically. Also in the radiation intensifying screen used in the present invention, it is desirable to coat the phosphor layer with such a transparent protective film.

The thickness of the protective film is generally in the range of about 0.1 μm to about 20 μm.

The transparent protective film can be provided on the surface of the phosphor layer by coating the phosphor layer with a solution prepared by dissolving in an appropriate solvent a transparent high molecular substance such as a cellulose derivative (e.g., cellulose acetate, cellulose nitrate) or a synthetic polymer (e.g., Polymethylmethacrylate, polyvinyl butyral, polyvinyl formal, polycarbonate, polyvinyl acetate, vinyl chloride-vinyl acetate copolymers). The protective film can also be provided in another manner such that a protective film forming sheet, e.g., a plastic sheet such as a sheet of polyethylene terephthalate, polyethylene naphthalate, polyethylene, polyvinylidene chloride, polyamide, etc., or a transparent glass plate, is prepared in advance, and then bonded to the surface of the phosphor layer using an appropriate adhesive.

As for the protective film of the radiation intensifying screen used in the present invention, a film formed from a coating composition containing an organic solvent-soluble fluororesin is preferred in particular. The term "fluororesin" as used herein is intended to include homopolymers of fluorine-containing olefins (fluoroolefins) and copolymers containing fluorine-containing olefins as a copolymerizing component. A film as a fluororesin coating may undergo a cross-linking reaction. The protective film of a fluororesin has advantages in that stains such as a plasticizer and other additives oozed out of an X-ray film or the like are hard to permeate into the protective film even when these films are brought into contact with each other, so that the stains can be easily removed, e.g., by wiping them off.

Also in the case using an organic solvent-soluble fluororesin as protective film forming material, film formation can be easily performed by coating a solution prepared by dissolving a fluororesin in an appropriate solvent and then by drying it. More specifically, a coating solution containing an organic solvent-soluble fluororesin as a protective film forming material is uniformly applied to the surface of the phosphor layer with a doctor blade or the like and then dried to make it into a film. The protective film and the phosphor layer may be formed at the same time using a simultaneous double-layered coating technique.

Specific examples of the foregoing fluororesin, which is, as described above, a homopolymer of fluorine-containing olefin (a fluoroolefin homopolymer) or a copolymer containing a fluoroolefin as a copolymerizing component, include polytetrafluoroethylene, polychlorotrifluoroethylene, polyvinyl fluoride, polyvinylidene fluoride, tetrafluoroethylene-hexafluoropropylene copolymers and fluoroolefine-vinyl ether copolymers. Although fluororesins are generally insoluble in organic solvents, the copolymers containing fluoroolefins as a copolymerizing component can be rendered soluble in organic solvents by other constitutional units (a copolymerizing component other than fluoroolefins). Therefore, a coating solution can be easily prepared by dissolving such copolymers in an appropriate solvent, and it can be easily made into a film by coating it on the phosphor layer and then drying it. As for the copolymer described above, fluoroolefin-vinyl ether copolymers are examples thereof. In addition, polytetrafluoroethylene and modification products thereof are soluble in certain fluorine-containing organic solvents, e.g., perfluoro solvents. Therefore, in analogy with the foregoing copolymers containing fluoroolefins as copolymerizing component, those polymers also can be made into a protective film using a coating technique.

In the protective film, a resin other than a fluororesin may be contained, and a cross-linking agent, a hardening agent, a yellowing inhibitor and so on may also be contained. For fully achieving the above-described purpose, however, it is desirable to control the content of a fluororesin in the protective film to at least 30 wt %, preferably at least 50 wt %, and particularly preferably at least 70 wt %. Specific examples of a resin which can be contained in the protective film in addition to a fluororesin include polyurethane resins, polyacrylic resins, cellulose derivatives, polymethylmethacrylate, polyester resins, epoxy resins and so on.

Further, the protective film of the intensifying screen used in the present invention may be a coating in which either an oligomer having a polysiloxane skeleton or an oligomer containing perfluoroalkyl groups, or both of them are contained. As for the oligomer having a polysiloxane skeleton, an oligomer having a dimethylpolysiloxane skeleton is an example thereof, and it is desirable that the oligomer has at least one functional group (e.g., hydroxyl group). Further, it is favorable for the oligomer to have a weight-average molecular weight of from 500 to 100,000, preferably from 1,000 to 100,000, and particularly preferably from 3,000 to 10,000. As for the oligomer containing perfluoroalkyl groups, on the other hand, it is desirable that the oligomers contain at least one functional group (e.g., hydroxyl group) in a molecule, and has a weight-average molecular weight of from 500 to 100,000 (on weight average), preferably from 1,000 to 100,000, and particularly preferably from 10,000 to 100,000. The oligomer containing a functional group is used to advantage. This is because the effect produced by addition of the oligomer can last long since a cross-linking reaction takes place between the functional group of the oligomer and a protective film-forming resin upon formation of the protective film, and thereby the oligomer is introduced into the molecular structure of the film-forming resin. Owing to the introduction of the oligomer into the resin molecule, it does not occur that the oligomer is removed from the protective film by long-term repeated use of the radiation-image transforming panel, a cleaning operation for the protective film surface or so on.

In the protective film, it is desirable that the oligomer is contained in a proportion of 0.01 to 10 wt %, particularly 0.1 to 2 wt %.

Furthermore, the protective film may contain a perfluoroolefin resin powder or a silicone resin powder. The perfluoroolefin resin powder and the silicone resin powder are preferably have their respective average grain sizes in the range of 0.1 to 10 μm, particularly 0.3 to 5 μm. Such a powder is desirably contained in the protective film in a proportion of 0.5 to 30 wt %, preferably 2 to 20 wt %, and particularly preferably 5 to 15 wt %, to the whole weight of the protective film.

As described above, it is desirable that the radiation intensifying screen used in the present invention be designed so as to have high sensitivity and to bear characteristics such that the contrast transfer function (CTF) values are at least 0.79 at the spacial frequency of 1 cycle/mm and at least 0.36 at the spacial frequency of 3 cycles/mm.

Further, when a graph is drawn, with spacial frequency (cycle/mm) as abscissa and contrast transfer function (CTF) as ordinate, by successively connecting the points represented by the following data on the relation between the cycle/mm and CTF values so as to form a smooth curve, it is especially desirable that the radiation intensifying screen used in the present invention have as its characteristics higher CTF values than the CTF values on the aforementioned curve over the whole range of spacial frequency.

| cycle(s)/mm | CTF |
|---|---|
| 0.00 | 1.00 |
| 0.25 | 0.950 |
| 0.50 | 0.905 |
| 0.75 | 0.840 |
| 1.00 | 0.790 |
| 1.25 | 0.720 |
| 1.50 | 0.655 |
| 1.75 | 0.595 |
| 2.00 | 0.535 |
| 2.50 | 0.430 |
| 3.00 | 0.360 |
| 3.50 | 0.300 |
| 4.00 | 0.255 |
| 5.00 | 0.180 |
| 6.00 | 0.130 |

The measurement and the calculation of the contrast transfer function from the radiation intensifying screen to the photosensitive material can be carried out using the sample obtained by printing a rectangular chart on a one-sided material MRE, products for mammography of Eastman Kodak Co.

The radiation intensifying screens suitable for the present invention, which have the characteristics illustrated above, can be obtained, e.g., by using as binder such thermoplastic elastomers as described above, and adopting a method comprising a step of compressively stressing the phosphor layer.

The protective layer of the radiation intensifying screen is preferably a transparent synthetic resin layer having a thickness of 5 μm or less which is formed on a phosphor layer using a coating technique. Such a thin protective layer can diminish the distance from the phosphor in the radiation intensifying screen to the silver halide photographic material, and so it can contribute to improvement in sharpness of the X-ray image formed in the photographic material.

In recent years, a high-temperature rapid development processing has been rapidly spread into the photosensitive materials, and in automatic development processing of various photosentive materials, the processing time has greatly been reduced.

In particular, in X-ray photosensitive materials for direct radiography, there is a competition in the processing time and rapid processing systems which enables 45 seconds' dry-to-dry processing have been marketed. On carrying out urgent medical diagnosis, it is very important to subject X-ray photosensitive materials to rapid development processing. Therefore, the demand for rapid processing has been increased. In order to attain this rapid processing system, it is necessary to keep the photographic performance and discolor the sensitizing dye and/or the crossover cut dye with the short developing time.

As for the image-forming system of the present invention, it is desirable that the silver halide photographic material, which has on the front and the back sides respectively the light-sensitive layers fulfilling the aforementioned sensitivity requirements and bearing characteristics substantially the same in both layers, be combined with the radiation intensifying screens having characteristics as defined above, and that substantially the same in both screens, so that the screens may be disposed on both sides (the front and the back sides) of the photographic material respectively. However, as disclosed in U.S. Pat. No. 4,710,637, the intensifying screen on the front side may be lower in phosphor content than the intensifying screen on the back side in order to acquire improved balance between the image sharpness and the photographic speed.

More specifically, in order that the system of the present invention has such a degree of photographic speed as not to cause problems in practical use and ensures a high level of quality to the X-ray image formed therein by photograph-taking, it is desirable that the silver halide photographic material be combined with two sheets of radiation intensifying screens so that the resulting system may achieve such photographic speed that the image having a density of 1.0 can be formed when the system is exposed to 0.5–1.5 mR of X rays emitted from a 80 KVp three-phase X-ray source and the development-processing is carried out with the developer defined hereinbefore under the condition also defined hereinbefore.

For evaluation of the system constituted of the present silver halide photographic material and two sheets of radiation intensifying screens, the following determination method is adopted. The basis of the evaluation is also described below.

As a generally used method for determining the image efficiency of the X-ray photograph taking system which is constituted of a silver halide photographic material and radiation intensifying screens, there is a method of determining the quantum detecting efficiency (DQE). On the other hand, there is the determination of noise equivalent quantum (NEQ) as the method of measuring the image by collectively evaluating sharpness and granularity. DQE is the quotient of the $(\text{signal/noise})^2$ value of the image, which is finally formed in the photographic material by the X-ray photography using the foregoing system, divided by the $(\text{signal/noise})^2$ value of the incident X rays. While DQE becomes 1 in a case that ideal image formation is performed, it is less than 1 in usual cases. On the other hand, NEQ is the numerical value corresponding to $(\text{signal/noise})^2$ of the final image. Further, there is the following relationship between DQE and NEQ:

$$\text{DQE}(V)=\text{NEQ}(V)/Q$$

$$\text{NEQ}(V)=(\log_{10}e\times\gamma.(\text{MTF}(V))^2/\text{NPS}_0(V)$$

wherein $\gamma$ is contrast, MTF(V) is the modulation transfer function of an image, $\text{NPS}_0(V)$ is the power spectrum of output noise, V is a spacial frequency, and Q is an incident X-ray quantum number.

The relationship between the photographic speed and the image quality can be evaluated using DQE. Specifically, a high DQE value system suggests that the system is excellent in balance between the photographic speed and the image quality. On the other hand, the image quality of the final image can be evaluated using NEQ. Specifically, the higher the NEQ value is, the better quality the image can be judged to have. However, NEQ is a value referring to the evaluation of physical image quality, but it does not always have one-to-one correspondence to clinical image discrimination. Because if there is a great difference between the granularity and the sharpness of the image, it cannot be said that the image provides a high visible image quality clinically. In evaluating the image quality from the clinical point of view, it is therefore desirable to use both NEQ and MTF values.

Next, the present invention will be explained in more detail by means of the following examples, which, however, are not intended to restrict the scope of the present invention.

EXAMPLE 1

[1] Preparation of Emulsions A to E 10 mg of sodium thiosulfate 5-hydrate, 4 g of potassium rhodanide and 10 cc of glacial acetic acid were added to one liter of 2 wt % gelatin solution containing 4.8 g of potassium bromide and 4 g of sodium paratoluenesulfinate, and 14 cc of an aqueous solution containing 5.2 g of silver nitrate and 7 cc of an aqueous solution containing 1.8 g of potassium bromide and 0.33 g or potassium iodide were added thereto, while vigorously stirring, by a double jet method over a period of 30 seconds. Afterwards, 30 cc of an aqueous solution containing 3 g of potassium iodide were added thereto.

200 cc of an aqueous solution containing 78 g of silver nitrate were added to the liquid prepared above over a period of 15 minutes. After one minute, 200 cc of an aqueous solution containing 50.6 go of potassium bromide and 3.65 g of potassium iodide were added thereto over a period of 15 minutes. Next, 14 cc of aqueous 25 wt % ammonia were added thereto, and the liquid was ripened for 10 minutes. Then, an aqueous solution containing 117 g of silver nitrate and an aqueous solution containing 82.3 g of potassium bromide were added thereto by a double jet method over a period of 14 minutes. The temperature of the reaction system in all of the above-mentioned steps was kept at 70° C.

The reaction liquid prepared above was washed by ordinary flocculation, and gelatin, a viscosity-increasing agent and an antiseptic were added and dispersed therein at 40° C. Then, the pH and the pAg of the reaction liquid were adjusted at 5.6 and 8.9, respectively. Next, while the reaction liquid was kept at 55° C., 21 mg of 4-hydroxy-6-methyl-1,3,3a,7-tetraazaindene and 460 mg of Sensitizing Dye I (see blow) were added thereto, and the liquid was ripened for 10 minutes. Then, 3.8 mg of sodium thiosulfate 5-hydrate, 3.5 g of Selenium Compound I (see below), 77 mg of potassium rhodanide and 2.6 mg of chloroauric acid were added thereto in this order, and the reaction liquid was ripened for 50 minutes. Next, 70 mg of 4-hydroxy-6-methyl-1,3,3a,7-tetrazaindene were added thereto and cooled. In this way, Emulsion A was obtained.

Sensitizing Dye I:

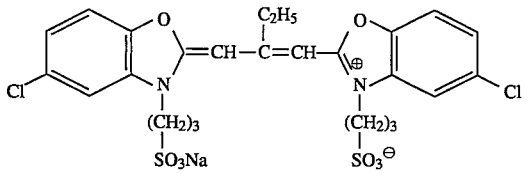

Selenium Compound I:

-continued

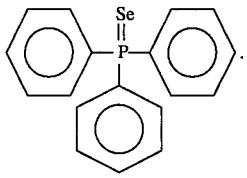

Emulsions B to E were prepared in the same manner as in the preparation of Emulsion A mentioned above, except that the conditions shown in Table 1 below were employed. Accordingly, Emulsions A to E each having a different mean grain size were obtained.

TABLE 1

| | Emulsion A | Emulsion B | Emulsion C | Emulsion D | Emulsion E |
|---|---|---|---|---|---|
| Reaction Temperature | 70° C. | 70° C. | 65° C. | 60° C. | 55° C. |
| Amount of Potassium Rhodanide Added | 4 g | 2 g | 1.2 g | 1.2 g | 1.2 g |
| Amount of Sensitizing Dye I Added | 460 mg | 460 mg | 610 mg | 700 mg | 750 mg |
| Amount of Selenium Compound I Added | 3.5 mg | 3.8 mg | 5.5 mg | 7.0 mg | 9.0 mg |
| *number average diameter of spheres corresponding to grains (μm) | 0.75 | 0.54 | 0.48 | 0.40 | 0.32 |

*Measured with a coal tar counter.

[2] Preparation of Supports X, Y and Z (1) Preparation of Dye Dispersion A for Subbing Layer:

The following Dye-I was treated with a ball mill according to the method disclosed in JP-A-63-197943.

Dye-I

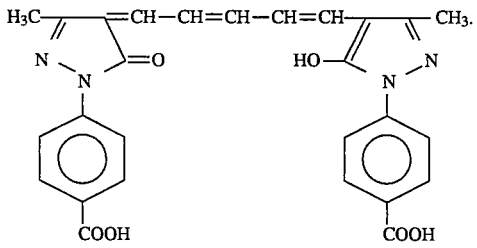

Water in an amount of 434 ml and 791 ml of a 6.7% water solution of a surfactant, Triton X-200, were placed in a 2-liter ball mill. Thereto, 20 g of Dye-I and 400 ml of zirconium oxide ($ZrO_2$) beads (2 mm in diameter) were added successively. The content in the ball mill was ground for 4 days. Then, 160 g of 12.5% gelatin solution was added thereto. After defoaming, the $ZrO_2$ beads were filtered out. According to the observation of the thus obtained dye dispersion, the ground dye had a wide particle size distribution. More specifically, the diameters of the dye particles are in the range of 0.05 to 1.15 μm and an average particle size thereof was 0.37 μm.

From the dispersion, dye particles measuring no smaller than 0.9 μm in size were removed by a centrifuging operation. Thus, Dye Dispersion A was obtained.

(2) Preparation of Support:

A biaxially stretched 175 μm-thick blue-colored polyethylene terephthalate film was subjected to a corona discharge treatment, and then coated with 4.9 ml/m$^2$ of a first subbing layer having the following composition by means of a wire-bar coater, and dried at 185° C. for 1 minutes.

On the back side also, the first subbing layer was provided in the same manner as described above.

Composition of First Subbing Layer

| | |
|---|---|
| Butadiene-styrene copolymer latex solution (solid proportion: 40%, butadiene/styrene ratio = 31/69 by weight) | 158 ml |
| Sodium 2,4-dichloro-6-hydroxy-s-triazine (4% solution) | 41 ml |
| distilled water | 300 ml |

The first subbing layer on each side of the film was coated with the second subbing layer having the following composition by means of a wire-bar coater and dried at 155° C. so that the following ingredients might have their respective coverage rates set forth below.

Composition of Second Subbing Layer

| | |
|---|---|
| Gelatin | 160 mg/m$^2$ |
| Dye Dispersion A (on a solids basis) | 25 mg/m$^2$ |
| $C_{12}H_{25}O(CH_2CH_2O)_{10}H$ | 1.8 mg/m$^2$ |
| Proxel | 0.27 mg/m$^2$ |
| Matting agent (polymethylmethacrylate particles having an average size of 2.5 μm) | 2.5 mg/m$^2$ |

Thus, Support X containing a crossover cut layer was prepared. In addition, Supports Y and Z were prepared in the same manner as Support X, except that the preparation condition was changed to those shown in Table 2.

TABLE 2

| | Support X | Support Y | Support Z |
|---|---|---|---|
| Coverage of Dye-I (mg/m$^2$) | 25 | 0 | 40 |
| Undercoat thickness (upper layer) μm | 0.17 | 0.15 | 0.16 |
| Density (both-side) at 550 nm | 0.48 | 0.12 | 0.70 |

[3] Preparation of Coating Composition

The following chemicals were added to each of Emulsions A to E to prepare coating compositions for emulsion layer. In addition, also prepared was a coating composition for protective layer having the composition mentioned below.

Coating Composition for Emulsion Layer:

| | |
|---|---|
| Emulsion A, B, C, D or E | 1 Kg (gelatin: 83 g, Ag: 92 g) |
| Dextran (average molecular weight: 39,000) | 18 g |
| Sodium Polyacrylate (average molecular weight: 41,000) | 3 g |
| Sodium Polystyrenesulfonate (average molecular weight: 600,000) | 1 g |
| Potassium Iodide | 83 mg |
| Trimethylolpropane | 5 g |
| Polymer latex (ethylacrylate/methacrylic acid ratio in the polymer = 97/3 by weight) | 5 g |
| Hardener [1,2-bis(vinylsulfonylacetamido)-ethane] | 2.7 g |
| 2,6-Bis(hydroxyamino)-4-diethylamino-1,3,5-triazine | 55 mg |

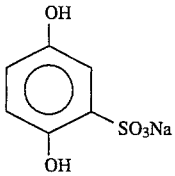

4 g

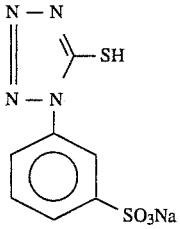

70 mg

| | |
|---|---|
| Emulsion of the following Dye | 0.4 g (as dye) |

Dye

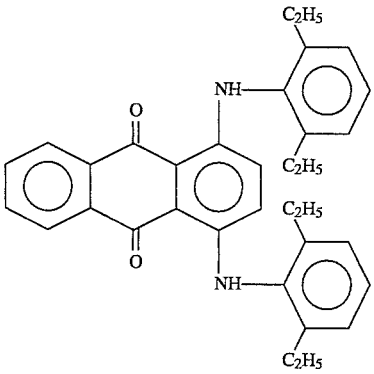

| | |
|---|---|
| Distilled Water | up to 2.2 1 |

Coating Composition for Protective Layer:

| | |
|---|---|
| Gelatin | 1 kg |
| Dextran (average molecular weight: 39,000) | 200 g |
| $C_{16}H_{33}O(CH_2CH_2O)_{10}H$ | 39 g |
| $C_8F_{17}SO_2N(C_3H_7)(CH_2CH_2O)_4(CH_2)SO_3Na$ | 1.6 g |
| $C_8F_{17}SO_3K$ | 7 g |
| Polymethylmethacrylate particles (average particle size: 3.7 μm) | 91 g |
| Proxel | 0.7 g |
| Sodium polyacrylate (average molecular weight: 41,000) | 45 g |
| Sodium polystyrenesulfonate (average molecular weight: 600,000) | 3 g |
| NaOH | 1.6 g |
| $C_8H_{17}C_6H_4(OCH_2CH_2)_3SO_3Na$ | 24 g |
| Distilled water | up to 14.4 1 |

[4] Preparation of Photosensitive Materials

Each photosensitive material was prepared under the same condition by coating and drying the coating compositions prepared in [3] on both sides of the support prepared in [2] in accordance with a simultaneous extrusion method. Therein, the gelatin coverage of the protective layer was adjusted to 1 g/m$^2$. The coating conditions are summarized in Table 3.

TABLE 3

| Sample No. | Upper Emulsion (Ag amount*: g/m$^2$) | Lower Emulsion (Ag amount*: g/m$^2$) | Support (dye amount*: mg/m$^2$) | Note |
|---|---|---|---|---|
| 1 | Emulsion A (2.2) | — | X (25) | comparison |
| 2 | Emulsion B (1.8) | — | " | " |
| 3 | Emulsion C (1.6) | — | " | " |
| 4 | Emulsion D (1.5) | — | " | " |
| 5 | Emulsion E (1.4) | — | " | " |
| 6 | Emulsion A (1.55) | Emulsion C (0.5) | " | invention |
| 7 | Emulsion B (1.55) | Emulsion D (0.22) | " | comparison |
| 8 | Emulsion B (1.26) | Emulsion D (0.45) | " | invention |
| 9 | Emulsion B (1.08) | Emulsion D (0.60) | " | " |
| 10 | Emulsion B (0.90) | Emulsion D (0.75) | " | comparison |
| 11 | Emulsion B (1.26) | Emulsion D (0.45) | Y (0) | " |
| 12 | Emulsion B (1.26) | Emulsion D (0.45) | Z (40) | invention |
| 13 | Emulsion C (1.12) | Emulsion E (0.42) | X (25) | " |
| 14 | Emulsion C (1.12) | Emulsion E (0.42) | Y (0) | comparison |
| 15 | Emulsion C (1.12) | Emulsion E (0.42) | Z (40) | invention |

*: This means the amount of Ag in the emulsion layer on one surface and the amount of dye in the support.

[5] Sensitometry

Each of the photosensitive materials as subjects of evaluation was sandwiched between two sheets of commercial screen, HR-4, products of Fuji Photo Film Co., Ltd., and subjected to stepwise exposure in which the amount of X rays was changed by a width of log E=0.15 at a step by varying the distance between the screen and the X-ray source.

Therein, there was used an X-ray tube, DRX-3724 HD, products of Toshiba Electric Co., Ltd., which emitted X rays using a tungsten target and setting its focal spot size at 0.6 mm×0.6 mm via an iris and 3 mm-thick aluminum equivalent material. The X rays emitted by applying an electric potential of 80 KVp to the X-ray tube with a three-phase pulse generator was passed through a filter of 7 cm-thick water having absorption almost equivalent to the human body. The resulting X rays were used herein as the light source.

After photographing, each photosensitive material was subjected to the photographic processing operation described hereinbefore using a roller conveyable type automatic developing machine (Auto Processor Model FPM-5000, made by Fuji Photo Film Co., Ltd.), wherein the development-processing was carried out at 35° C. using Developer I and the fixation-processing at 25° C. using Fixer F (comprising 200 ml of ammonium thiosulfate (70% by weight/volume), 20 g of sodium sulfite, 8 g of boric acid, 0.1 g of disodium ethylenediaminetetraacetate (dihydrate), 15 g of aluminum sulfate, 2 g of sulfuric acid, 22 g of glacial acetic acid and water in such an amount as to make the total volume one liter, and being adjusted to pH 4.5), thereby obtaining a sample for measurement.

The density measurement of the thus obtained samples was carried out with visible rays, and the characteristic curves thereof were determined.

The reciprocal of the exposure amount of X rays required for providing the density of 1.2 was taken as the standard of sensitivity. The sensitivities of the samples were shown as relative values. Moreover, the characteristic curves obtained were each differentiated to determine gamma values, thereby plotting the obtained data, with the gamma value as ordinate and log E as abscissa. Using the thus obtained gamma curve, point gamma values corresponding to the density range of 0.7 to 1.5 and point gamma values corresponding to the density range of 2.0 to 2.8 were determined. The results obtained are shown in Table 4.

Apart from the above-mentioned process, each photographic material sample was exposed to a tungsten light at its both sides each through a filter characterized by the transmission peak wavelength of 545 nm and the half-value width of 20 nm. The tungsten lamp used had a color temperature of 2856° K. Using the filter, the tungsten light of about 545 nm (this corresponds to the main wavelength of the light to be emitted by the radiation-intensifying screens that were combined with the photographic material sample) was selected and radiated to the sample. The both surfaces of the sample were exposed to the same amount of the tungsten light through a neutral step-wedge for 1/20 seconds. The exposed samples were developed under the same conditions as those in the above-mentioned process to obtain their characteristic curves. From these, the point gamma values were obtained in the same manner as above. The results are shown in Table 4.

[6] Determination of Crossover Rate

The sample silver halide photographic material was placed between a sheet of black paper and a radiation intensifying screen, HR-4 (containing terbium-activated gadolinium oxysulfide phosphor (main wavelength of emission: 545 nm, green light). The black paper on this combination was placed to face an X-ray source, and then exposed to X-rays. The X-ray source used in this measurement was the same as used in the sensitometry described above. The material was exposed to X-rays in various doses, which were adjusted by varying the distance between the intensifying screen and the X-ray source. After the exposing process was complete, the exposed material was developed in the same manner as stated in the measurement of sensitivity. The developed material was divided into two sheets. The photosensitive layer on each sheet was independently peeled off.

The density of the photosensitive layer having been in contact with the intensifying screen was found thicker than that of the photosensitive layer in the other side (black paper side). With respect to each of the remaining layers, the characteristic curve was obtained and the average difference of the sensitivity (Δlog E) was obtained from the straight line portion (density: 0.5 to 1.0) of each characteristic curve; and then the crossover rate was calculated based on the estimated average difference of the sensitivity (Δlog E) in accordance with the following formula:

$$\text{Crossover Rate } (\%) = 100/(\text{antilog}(\Delta\log E) + 1)$$

[7] Determination of CTF

Each of the photosensitive materials as subjects of evaluation was sandwiched between two sheets of Screen HR-4, and placed at a distance of 2 m from an X-ray source. The X-ray source used was the same as used in the foregoing sensitometry. A photograph of a rectangular chart for MTF measurement (made of molybdenum, having a thickness of 80 μm and spacial frequencies from 0 cycle/mm to 10 cycles/mm) was taken using the foregoing X-ray image forming system. The photographic processing condition adopted therein was the same as in the foregoing sensitometry.

As for the exposure amount, it was controlled by changing the exposure time of X-rays so that the area corresponding to the molybdenum-unshielded part might have a density of 1.2.

Each of the X-ray photograph samples was scanned with a microdensitometer. The aperture used therein was a slit 30 μm wide in the scanning direction and 500 μm wide in the direction perpendicular to the scanning direction, and the density profile of each sample was determined at sampling intervals of 30 μm. This scanning operation was repeated 20 times, thereby calculating the average. The thus obtained average was taken as the density profile forming the basis of CTF calculation. Then, a square wave peak was detected at every frequency in the density profile, and thereby was calculated the density contrast at every frequency.

The density contrast values at the spacial frequencies 1 cycle/mm and 3 cycles/mm are shown in Table 4.

[8] Evaluation of X-ray Images of Leg Phantom and Stomach Phantom:

A leg phantom made by Kyoto Chemical Co. was set before an X-ray source at a distance of one meter therebetween, and a composition kit having one of the photographic material samples sandwiched between two intensifying screens of HR4 was set behind the phantom. The X-ray source was equipped with a 3 mm-thick aluminium-equivalent filter and had a focal spot size of 0.6 mm×0.6 mm, to which a voltage of 55 KVp was applied from a three-phase 12-pulse electric source. In this way, the phantom was photographed on the photographic material sample. Apart from this, a stomach phantom made by Kyoto Chemical Co. was set before an X-ray source of the same kind as above, at a distance of 1.2 m therebetween, and a composition kit having one of the photographic material samples sandwiched between two intensifying screens of HR4 was set behind the phantom via a scattering ray-cutting grid having a grid ratio of 8:1. The X-ray source had a focal spot size of 0.6 mm×0.6 mm, to which a voltage of 80 KVp was applied. In this way, the stomach phantom was photographed on the photographic material sample.

The exposed samples were developed by the same process as that employed for the measurement of the photographic properties as above, using an automatic developing machine FPM-5000 Model where Developer (I) and Fixer (F) were used. The processing was conducted at 35° C., and the time needed for the processing was 90 seconds in total while the time for development was 25 seconds.

By varying the time for exposure to X-ray in every combination kit, all the images were finished to have almost the same appropriate density. The finished photographs were spread on a Schaukasten and evaluated with the naked eye. For evaluating the photographs of the leg phantom, importance was attached to the clearness of the trabeculae of bone and the vividness of the soft tissues around the bones. For evaluating the photographs of the stomach phantom, importance was attached to the vividness of the fine structure of the gastric wall and the vividness of the gastric bubble. The results are shown in Table 4 below, where A means excellent, B means good, C means average and the image is at least usable for medical examination, and D means bad and the image is not usable for medical examination. The sub-marks a and z indicate the rank in the same evaluation point. For example, Aa means the highest rank in A, while Az means the lowest rank in A.

TABLE 4

| Sample | Sensitivity | Point Gamma (exposure to X-ray) | | Point Gamma (exposure to tungsten light) | | Crossover |
|---|---|---|---|---|---|---|
| No. | at D = 1.2 | at D = 0.7 to 1.5 | at D = 2.0 to 2.8 | at D = 0.7 to 1.5 | at D = 2.0 to 2.8 | (%) |
| 1 | 195 | 2.2–3.0 | 1.0–2.6 | 2.2–3.0 | 1.0–2.6 | 10 |
| 2 | 100 | 2.4–3.5 | 1.4–2.8 | 2.4–3.5 | 1.4–2.8 | 12 |
| 3 | 60 | 2.6–3.6 | 1.4–2.9 | 2.6–3.6 | 1.4–2.9 | 12 |
| 4 | 31 | 2.6–3.6 | 1.4–3.0 | 2.6–3.6 | 1.4–3.0 | 12 |
| 5 | 19 | 2.5–3.6 | 1.4–3.0 | 2.5–3.6 | 1.4–3.0 | 12 |
| 6* | 185 | 1.9–2.9 | 1.2–1.8 | 1.9–2.9 | 1.2–1.8 | 11 |
| 7 | 95 | 2.2–3.2 | 1.4–2.4 | 2.2–3.2 | 1.4–2.4 | 12 |
| 8* | 90 | 2.1–2.7 | 1.4–1.8 | 2.1–2.7 | 1.4–1.8 | 12 |

TABLE 4-continued

| | | | | | | |
|---|---|---|---|---|---|---|
| 9* | 85 | 1.9–2.4 | 1.6–1.7 | 1.9–2.4 | 1.6–1.7 | 12 |
| 10 | 80 | 1.6–2.1 | 1.6–1.7 | 1.6–2.1 | 1.6–1.7 | 12 |
| 11 | 105 | 2.1–2.7 | 1.4–1.8 | 2.1–2.7 | 1.4–1.8 | 25 |
| 12* | 87 | 2.1–2.7 | 1.4–1.8 | 2.1–2.7 | 1.4–1.8 | 6 |
| 13* | 55 | 2.2–2.8 | 1.4–1.9 | 2.2–2.8 | 1.4–1.9 | 12 |
| 14 | 65 | 2.2–2.8 | 1.4–1.9 | 2.2–2.8 | 1.4–1.9 | 25 |
| 15* | 53 | 2.2–2.8 | 1.4–1.9 | 2.2–2.8 | 1.4–1.9 | 6 |

| Sample | CTF | | Evaluation of Image of Bones with the naked eye | | Evaluation of Image of Stomach with the naked eye | |
|---|---|---|---|---|---|---|
| No. | 1 cycle/mm | 3 cycles/mm | Trabeculae of Bone | Soft Tissues | Gastric Wall | Gastric Bubble |
| 1 | 0.80 | 0.43 | B | C | B | C |
| 2 | 0.79 | 0.42 | A | C | A | C |
| 3 | 0.79 | 0.42 | Aa | C | Aa | C |
| 4 | 0.79 | 0.42 | — | — | — | — |
| 5 | 0.79 | 0.42 | — | — | — | — |
| 6* | 0.79 | 0.42 | B | B | B | B |
| 7 | 0.79 | 0.42 | A | Ca | A | Ca |
| 8* | 0.79 | 0.42 | A | B | A | B |
| 9* | 0.79 | 0.42 | Az | A | Az | A |
| 10 | 0.79 | 0.42 | B | A | Ba | A |
| 11 | 0.70 | 0.32 | B | A | B | A |
| 12* | 0.81 | 0.45 | A | A | A | A |
| 13* | 0.79 | 0.42 | Aa | A | Aa | A |
| 14 | 0.71 | 0.32 | Ba | A | Ba | A |
| 15* | 0.81 | 0.45 | Aa | A | Aa | A |

*samples of the invention

Table 4 verifies the following facts:

(1) Photographic material sample Nos. 6, 8, 9, 12, 13 and 15 of the present invention, having a low crossover value and having point gamma values falling within the particular ranges, have a high CTF value and gave good bone images where the trabeculae of bone and the soft tissues around bones were vivid and well-balanced. They also gave good stomach images where both the gastric wall and the gastric bubble were vivid and well-balanced.

(2) Photographic material samples having a large crossover value gave bad images where the trabeculae of bone and the gastric wall were not vivid.

(3) Both the exposure to X-ray via the intensifying screen and the exposure to the light having the same wavelength as the peak wavelength of the light emitted by the intensifying screen gave the same characteristic curve profile.

(4) It is understood that the photographic material samples of the present invention having point gamma values falling within the particular ranges were obtained when two emulsions each having a different sensitivity were used to prepare them in such a way that the ratio of the sensitivities was within the range of from 1:0.35 to 1:0.25 and that the amounts of the emulsions were properly controlled.

EXAMPLE 2

Using photographic material sample No. 2 and Nos. 7 to 10 prepared in Example 1, images of a leg phantom were formed in the same manner as in Example 1. In this example, images having a density of 1.0 (proper density) at a determined point of the bone were formed. In addition to these, other images were also formed while the amount of exposure was increased or decreased by 15% of the amount of exposure needed for obtaining the proper density.

The density of each image at a determined point of the soft tissues was measured, and the vividness of the soft tissues and that of the trabeculae of bone were evaluated with the naked eye. The results obtained are shown in Table 5 below.

TABLE 5

| Sample No. | Condition for Exposure | Density of Soft Tissues at Determined Point | Evaluation of Images of Bones with the naked eye: Trabecule of Bone | Evaluation of Images of Bones with the naked eye: Soft Tissues | Point Gamma at D = 0.7 to 1.5 | Point Gamma at D = 2.0 to 2.8 | Remarks |
|---|---|---|---|---|---|---|---|
| 2 | −15% | 2.75 | Az | Ca | 2.4–3.5 | 1.4–2.8 | comparative sample |
| | ±0% | 2.80 | A | C | | | |
| | +15% | 2.98 | A | D | | | |
| 7 | −15% | 2.55 | Az | B | 2.2–3.2 | 1.4–2.4 | comparative sample |
| | ±0% | 2.70 | A | Ca | | | |
| | +15% | 2.88 | A | Cz | | | |
| 8 | −15% | 2.50 | Az | Ba | 2.1–2.7 | 1.4–1.8 | sample of the invention |
| | ±0% | 2.60 | A | B | | | |
| | +15% | 2.70 | A | Bz | | | |

TABLE 5-continued

| Sample No. | Condition for Exposure | Density of Soft Tissues at Determined Point | Evaluation of Images of Bones with the naked eye: Trabecule of Bone | Evaluation of Images of Bones with the naked eye: Soft Tissues | Point Gamma: at D = 0.7 to 1.5 | Point Gamma: at D = 2.0 to 2.8 | Remarks |
|---|---|---|---|---|---|---|---|
| 9 | −15% | 2.45 | Az | A | 1.9–2.4 | 1.6–1.7 | sample of the invention |
| | ±0% | 2.55 | Az | A | | | |
| | +15% | 2.65 | Az | A | | | |
| 10 | −15% | 2.30 | B | A | 1.6–2.1 | 1.6–1.7 | comparative sample |
| | ±0% | 2.40 | B | A | | | |
| | +15% | 2.50 | B | A | | | |

Table 5 verifies the following facts:

(1) Where the photographic material samples were subjected to exposure corresponding to the proper exposure (enough to give a bone density of 1.0)± 15% to take pictures of the leg phantom, the sample Nos. 8 and 9 of the present invention gave satisfactory images for medical examination. From this, it is noted that the samples of the present invention have a broad exposure latitude.

(2) The comparative sample Nos. 2 and 7 having high point gamma values at D=2.0 to 2.8 gave bad pictures where the soft tissues around the bones were not vivid, when they were over-exposed.

(3) The comparative sample No. 10 having low point gamma values at D=0.7 to 1.5 gave bad pictures where the trabeculae of bone were not vivid, though the variation in the image quality of the pictures given by them was small when the exposure amount was varied.

EXAMPLE 3

[1] Preparation of Intensifying Screen

In order to form a phosphor sheet, 200 g of a phosphor ($Gd_2O_2S$:Tb), 20 g of Binder A (polyurethane, Desmolack TPKL-5-2625 [solid portion: 40%], trade name, products of Sumitomo Bayer Urethane Co., Ltd.) and 2 g of Binder B (nitrocellulose having a nitrification degree of 11.5%) were added to methyl ethyl ketone as a solvent, and dispersed with a propeller mixer to prepare a coating composition (viscosity: 30 PS at 25° C., binder/phosphor ratio: 1/20). This coating composition was applied to a 180 μm-thick polyethylene terephthalate film coated with a silicone type surface lubricant (temporary support) at a coverage such that the thickness of the coating might be 160 μm after the compressive stressing treatment described hereinafter; dried and then peeled apart from the temporary support. Thus, a phosphor sheet was obtained.

Separately, a dispersion as a coating composition for forming a subbing layer was prepared by adding 90 g of a soft acrylic resin and 50 g of nitrocellulose to methyl ethyl ketone and mixing them. The dispersion obtained had a viscosity of 3-6 PS (at 25° C.).

The coating composition for a subbing layer was uniformly spread over a 250 μm-thick titanium dioxide-mixed polyethylene terephthalate film (support) placed horizontally on a glass plate, and then dried as the temperature of the glass plate was gradually raised from 25° C. up to 100° C. to form the subbing layer (thickness: 15 μm) on the support. On this subbing layer, the phosphor sheet prepared previously was superposed, and compressively stressed at 80° C. under the applied pressure of 400 Kgw/cm$^2$ using a calender roll.

Further, a coating composition for forming a protective film was prepared by adding 70 g of a fluororesin (fluorophlein-vinyl ether copolymer, Lumiflon LF 100, trade name, products of Asahi Glass Company, Ltd.), 25 g of a cross-linking agent (isocyanate, Desmodur Z 4370, trade name, products of Sumitomo Bayer Urethane Co., Ltd.), 5 g of bisphenol A type epoxy resin and 5 g of an alcohol-modified silicone oligomer (a silicone oligomer having a dimethylpolysiloxane skeleton and hydroxyl groups (carbinol groups) at the both ends, X-22-2809, trade name, products of Shin-etsu Chemical Industry Co., Ltd.) to a toluene-isopropyl alcohol (1:1 by volume) mixture as a solvent.

The thus prepared composition was coated on the surface of the phosphor sheet, which had previously undergone the compressive stressing treatment on the support, by means of a doctor blade, and then dried and thermally cured by 30 minutes' heating at 120° C. Thus, a transparent protective film having a thickness of 3 μm was formed.

In the above-described manner, a Radiation Intensifying Screen A constituted of a support, a subbing layer, a phosphor layer and a transparent protective film was obtained.

Evaluation of Characteristics of Radiation Intensifying Screen:

1) Measurement of X-ray Absorption

X rays generated from a tungsten target tube operated by 80 KVp three-phase electric power supply were transmitted by a 3 mm-thick aluminum plate, and reached a radiation intensifying screen sample placed at a distance of 200 cm from the tungsten anode of the target tube. The amount of X rays transmitted by the intensifying screen sample was measured with an electric dissociation type dosimeter placed behind the phosphor layer of the intensifying screen at a distance of 50 cm. As for the standard, there was adopted the amount of X rays measured at the above-described position without being transmitted by any intensifying screen.

The data on the amount of X rays absorbed by each intensifying screen sample are shown in Table 6.

(2) Determination of Contrast Transfer Function (CTF)

A one-side photosensitive material MRE, products of Eastman Kodak Co., Ltd., was disposed in contact with each intensifying screen as subject of evaluation, and therein was formed the image of a rectangular chart for MTF measurement (made of molybdenum, having a thickness of 80 μm and spacial frequencies from 0 cycle/mm to 10 cycles/mm). The rectangular chart was placed at a distance of 2 m from the X-ray tube. The X-ray source was arranged in front of the photosensitive material, and the intensifying screen sample was placed at the back of the photosensitive material. Herein, there were adopted the same X-ray source, photographic processing condition and CTF determination condition as used in Example 1.

In photographing, the exposure amount was controlled by changing the exposure time of X-rays so that the high density area of the resulting photograph might become 1.8. The results obtained are also shown in Table 6.

(3) Determination of Sensitivity

Each intensifying screen sample was combined with a green-sensitive one-side photosensitive material MRE, products of Eastman Kodak Co., Ltd., and exposed stepwise by means of the same X-ray source as used in the determination of CTF. Therein, the amount of X rays was changed by a width of log E=0.15 at a step by varying the distance between the screen and the X-ray source. After the exposure, the photosensitive material underwent the same photographic processing operation as used in determining CTF values.

The density measurement of the thus processed photosensitive material was carried out using visible light, thereby obtaining a characteristic curve. The sensitivity was expressed in terms of the reciprocal of the exposure amount of X rays capable of providing the density of 1.8. The thus determined sensitivities of the intensifying screens are shown as relative values in Table 6, with the screen HR-4 for back-side arrangement being taken as 100.

TABLE 6

| Intensifying Screen | Absorption of X rays | Sensitivity | CTF 1 cycle/mm | CTF 3 cycles/mm |
|---|---|---|---|---|
| HR-3 (front) | 18.2% | 48 | 0.890 | 0.660 |
| HR-3 (back) | 18.2% | 48 | 0.889 | 0.660 |
| HR-4 (front) | 22.3% | 89 | 0.850 | 0.510 |
| HR-4 (back) | 23.1% | 100 | 0.850 | 0.506 |
| HR-8 (front) | 31.3% | 155 | 0.775 | 0.340 |
| HR-8 (back) | 32.2% | 170 | 0.763 | 0.336 |
| Intensifying Screen A | 32.8% | 200 | 0.869 | 0.494 |

As can be seen from Table 6, the Intensifying Screen A satisfies the requirements for achieving the satisfactory balance between the image quality and the sensitivity. These requirements are stated hereinbefore in connection with preferred embodiments of the present invention.

[2] Photosensitive Materials and Determination of Absolute Sensitivities Thereof The absolute sensitivities of the samples prepared in Example 1 and those of commercial photosensitive materials Super HRS and Super HRC, trade names, products of Fuji Photo Film Co., Ltd., were examined respectively.

In examining the sensitivity, each photosensitive material was exposed by means of a tungsten light source having a color temperature of 2856° K via a transmission filter having the transmission peak at 545 nm and the peak half-width of 20 nm (thereby the rays having their wavelength center at 545 nm, corresponding to the main emission wavelength of the radiation intensifying screen used hereinafter, were selectively taken out). Additionally, the exposure was carried out via a neutral step wedge, and the photosensitive material was irradiated with the selected rays for 1/20 second.

The exposed material was developed at 35° C. for 25 seconds (total processing time: 90 seconds) using Developer (I) in an automatic developing machine (FPM-5000, made by Fuji Photo Film Co., Ltd.). After the light-sensitive layer on the side opposite to the exposure side was peeled apart, density measurement was carried out to determine the characteristic curve. From the characteristic curve, the exposure amount necessary to provide the density of Dmin (minimum density) plus 0.5 was calculated, and set forth in Table 7 as the sensitivity expressed in lux.sec. In calculating the exposure amount, the illuminance of the light emitted by the tungsten light source and transmitted by the filter was measured with an illuminometer, Model PI-3F (corrected).

TABLE 7

| Photosensitive Mateial | Sensitivity on one side (Dmin + 0.5) |
|---|---|
| Super HRS (product of Fuji Photo Film Co., Ltd.) | 0.0076 lux · sec |
| Super HRC (product of Fuji Photo Film Co., Ltd.) | 0.0063 lux · sec |
| Sensitive Material Sample No. 8 | 0.0158 lux · sec |
| Sensitive Material Sample No. 14 | 0.0070 lux · sec |
| Sensitive Material Sample No. 19 | 0.0240 lux · sec |
| Sensitive Material Sample No. 12 | 0.0150 lux · sec |
| Sensitive Material Sample No. 13 | 0.0160 lux · sec |

As can be seen from Table 7, the photosensitive materials 8, 19 and 13 had their respective sensitivities in the range specified in order to achieve the satisfactory balance between the image quality and the photographic speed. The sensitivity range requirement is stated hereinbefore in connection with preferred embodiments of the present invention. (Although the photosensitive material No. 12 met the sensitivity range requirement, it had too high crossover rate.)

[3] Sensitometry and Determination of Crossover Rate (%) and CTF

The combinations of the photosensitive materials with the intensifying screens, set forth in Table 8, were each examined for characteristic curve, crossover rate (%) and CTF values using the same methods as in Example 1.

The results obtained are shown in Table 9.

[4] Measurement of Noise Power Spectrum ($NPS_0(V)$)

Each combination kit of the photosensitive material with the intensifying screens was exposed by means of the same X-ray source as used in measurement of MTF (80 KVp, equipped with 3 mm-thick aluminum equivalent material and the filter of 7 cm-wide water) placed at a distance of 2 m. Therein, the exposure amount was controlled so as to provide a density of 1.0 when the photosensitive material was developed. The samples prepared for measurement of $NPS_0$ were scanned with a microdensitometer. The aperture used therein was a slit 30 μm wide in the scanning direction and 500 μm wide in the direction perpendicular to the scanning direction. The density was measured at sampling intervals of 20 μm. The 8192 (points/line)×12 (lines) sampling was carried out, and the sampled points were partitioned every 256 points, followed by undergoing a FFT processing. The average number of FFT was 1320 times. As a result of the FFT processing, the noise power spectrum was determined.

[5] Calculation of NEQ

The calculation of NEQ was made according to the following equation:

$$NEQ(V)=(\log_{10} e\times\gamma.MTF(V))^2/NPS_0(V).$$

The NEQ values are shown as relative values, with the HR-4/Super HRS combination kit being taken as 100 (standard). As for the results obtained, the values at the spacial frequencies 1 cycle/mm and 3 cycles/mm are shown as the representatives in Table 9.

shown in Table 8 in terms of the same evaluation marks as those used in Example 1.

TABLE 8

| Combination Kit No. | Intensifying Screen | Photogaphic Material | Sensitivity at D = 1.2 | Point Gamma at D = 0.7 to 1.5 | Point Gamma at D = 2.0 to 2.8 | Crossover (%) |
|---|---|---|---|---|---|---|
| 1 | HR-3 | Super HRS | 55 | 1.9–3.0 | 1.4–2.5 | 18 |
| 2 | HR-4 | Super HRS | 100 | 1.9–3.0 | 1.4–2.5 | 18 |
| 3 | HR-4 | Super HRL | 100 | 1.8–2.5 | 1.1–1.9 | 18 |
| 4 | HR-8 | Super HRS | 180 | 1.9–3.0 | 1.4–2.5 | 18 |
| 5 | A | 6** | 205 | 1.9–2.9 | 1.2–1.8 | 11 |
| 6* | A | 8** | 100 | 2.1–2.7 | 1.4–1.8 | 12 |
| 7* | A | 13** | 60 | 2.2–2.8 | 1.4–1.9 | 12 |
| 8 | HR-8 | 8** | 90 | 2.1–2.7 | 1.4–1.8 | 12 |
| 9 | HR-8 | 13** | 55 | 2.2–2.8 | 1.4–1.9 | 12 |
| 10 | HR-4 | 6** | 100 | 1.9–2.9 | 1.2–1.8 | 11 |

| Combination Kit No. | CTF 1 cycle/mm | CTF 3 cycles/mm | NEQ 1 cycle/mm | NEQ 3 cycles/mm | DQE 1 cycle/mm | DQE 3 cycles/mm | Evaluation of Image of Stomach with the naked eye: Gastric Wall | Evaluation of Image of Stomach with the naked eye: Gastric Bubble |
|---|---|---|---|---|---|---|---|---|
| 1 | 0.82 | 0.51 | 131 | 162 | 72 | 89 | Ba | Ca |
| 2 | 0.72 | 0.37 | 100 | 100 | 100 | 100 | B | Ca |
| 3 | 0.72 | 0.37 | 100 | 100 | 100 | 100 | Bz | B |
| 4 | 0.65 | 0.23 | 82 | 52 | 148 | 93 | Ca | Ca |
| 5 | 0.75 | 0.35 | 90 | 75 | 180 | 130 | Bz | B |
| 6* | 0.74 | 0.34 | 182 | 132 | 182 | 132 | A | B |
| 7* | 0.74 | 0.34 | 297 | 217 | 178 | 130 | Aa | A |
| 8 | 0.69 | 0.25 | 172 | 105 | 155 | 95 | B | B |
| 9 | 0.69 | 0.25 | 273 | 169 | 150 | 93 | A | A |
| 10 | 0.79 | 0.42 | 105 | 110 | 105 | 110 | B | B |

*More preferred combination kits.
**Photographic material samples of the invention.
Sensitivity, NEQ and DQE are relative values based on the values (all 100) of the combination kit of Super HRS/HR-4.

[6] Calculation of DQE

The calculation of DQE was made according to the following equation:

$$DQE(V)=NEQ(V)/Q \text{ (Q=quantum number of incident X rays).}$$

As for the NEQ(V), the relative values determined above were used. Since Q is inversely proportional to the photographic speed of the combination kit of the photosensitive material with the intensifying screens, the foregoing equation can be converted to the following equation:

$$\text{Relative } DQE(V)=\text{relative } NEQ \times \text{Relative Speed.}$$

The relative DQE(V) values were calculated using the above equation, and they were shown as relative values with the HR-4/Super HRS combination kit being taken as 100 (standard). As for the results obtained, the values at the spacial frequencies 1 cycle/mm and 3 cycles/mm are shown as the representatives.

[7] Evaluation of X-ray Images of Stomach Phantom

The X-ray images of a stomach phantom that had been obtained in the same manner as in Example 1 were evaluated with respect to the vividness of the fine structure of the gastric wall and that of the gastric bubble. The results are Table 8 verifies the following facts:

(1) The combination kit Nos. 5 to 10 each having the photographic material of the present invention gave good stomach images where both the gastric wall and the gastric bubble were vivid and well-balanced.

(2) The combination kits having almost the same sensitivity were selected and the image quality of the images given by them was evaluated, resulting in the following facts:

(2-1) Combination kits having a sensitivity of from 55 to 60 (Nos. 1, 7, 9):

The combination kit No. 9 having the photographic material of the present invention was superior to the commercial combination kit No. 1 with respect to the vividness of the stomach image. The combination kit No. 7 having the intensifying screen A gave an excellent image. The graininess of the image given by the combination kit No. 7 was extremely fine and almost invisible.

(2-2) Combination kits having a sensitivity of from 90 to 100 (Nos. 2, 3, 6, 8, 10):

Regarding the stomach images given by them, the rank is No. 6 (best)> No. 8=No. 10> No. 2=No. 3 (worst). From this, it is understood that the image quality was improved by the use of the photographic materials of the present invention. In particular, it is understood that the combination composed of the intensifying screen A and the low-sensitivity photographic material is the best, as giving the most vivid image.

(2-3) Combination kits having a sensitivity of from 180 to 205 (Nos. 4, 5):

The kit No. 5 was better than the kit No. 4 with respect to both the sensitivity and the image quality.

(3) The combination kit Nos. 5 to 7 each having the intensifying screen A had almost the same DQE which is extremely high. This means that the balance between the sensitivity and the image quality in these kits was improved extremely.

EXAMPLE 4

Each of the samples prepared in Example 1 was sandwiched between two sheets of HR-4 and exposed in the same manner as in Example 1, and processed using each of the following three kinds of processing systems, thereby evaluating photographic characteristics. For the evaluation of photographic characteristics, the speed at the density of 1.2, the point gamma values in the density range of 0.7 to 1.5 and the point gamma values in the density range of 2.0 to 2.8 were chosen as the representatives. Further, the evaluation of color stain in the film was made as follows: The photosensitive material measuring 24 cm×30 cm in size was subjected to each of the following three kinds of photographic processing operations without undergoing any exposure operation, and the color stain thereby generated was evaluated by visual observation.

Processing System I:

Automatic Developing Machine FPM-5000 (produced by Fuji Photo Film Co., Ltd.) was used.

| Processing Step | Time | Temperature |
|---|---|---|
| Development with Developer I (described hereinbefore) | 25 sec. | 35° C. |
| Fixation with Fixer F (described hereinbefore) | 20 sec. | 25° C. |
| Washing | 12 sec. | 25° C. |
| Drying | 26 sec. | 55° C. |
| (Total processing time: 90 sec.) | | |

Processing System II:

An automatic developing machine, Fuji X-ray Processor Cepros M, produced by Fuji Photo Film Co., Ltd., was used.

| Processing Step | Time | Temperature |
|---|---|---|
| Development with Developer II | 13.7 sec. | 35° C. |
| Fixation with Fixer G | 10.6 sec. | 25° C. |
| Washing | 6.2 sec. | 25° C. |
| Drying | 14.1 sec. | 55° C. |
| (Total processing time: 45 sec.) | | |

| | |
|---|---|
| Potassium hydroxide | 18.0 g |
| Potassium sulfite | 75.0 g |
| Sodium carbonate | 3.0 g |
| Boric acid | 5.0 g |
| Diethylene glycol | 10.0 g |
| Diethylenetriaminepentaacetic acid | 2.0 g |
| 1-(N,N-Diethylamino)ethyl-5-mercaptotetrazole | 0.1 g |
| Hydroquinone | 27.0 g |
| 4-Hydroxymethyl-4-methyl-1-phenyl-3-pyrazolidone | 2.0 g |
| Triethylene glycol | 45.0 g |
| 3,3'-dithiobishydrosuccinic acid | 0.2 g |
| Glacial acetic acid | 5.0 g |
| 5-nitroindazole | 0.3 g |
| 1-Phenyl-3-pyrazolidone | 2.0 g |
| Glutaraldehyde (50%) | 10.0 g |
| Potassium bromide | 1.0 g |
| Potassium metabisulfite | 10.0 g |
| Water to make | 1 l |
| pH adjusted to | 10.5 |

Composition of Fixer G

| | |
|---|---|
| Ammonium thiosulfate (70 wt/vol %) | 200 ml |
| Disodium ethylenediaminetetraacetate dehydrate | 0.03 g |
| Sodium sulfite | 15.0 g |
| Boric acid | 4.0 g |
| 1-(N,N-Diethylamino)-ethyl-5-mercaptotetrazole | 1.0 g |
| Tartaric acid | 3.0 g |
| Sodium hydroxide | 15.0 g |
| Sulfuric acid (36 N) | 3.9 g |
| Aluminum sulfate | 10.0 g |
| Water to make | 1 l |
| pH adjusted to | 4.60 |

Processing System III:

A remodelled Fuji X-ray Processor Cepros M was used as automatic developing machine.

| Processing Step | Time | Temperature |
|---|---|---|
| Development with Developer III | 9.1 sec. | 35° C. |
| Fixation with Fixer G | 7.1 sec. | 25° C. |
| Washing | 4.1 sec. | 25° C. |
| Drying | 9.4 sec. | 55° C. |
| (Total processing time: 30 sec.) | | |

Developer III was the same as Developer II, except that the amounts of sodium carbonate and 1-phenyl-3-pyrazolidone used were changed to 30 g and 3.5 g respectively.

In remodelling the developing machine, the driving shaft was reconstructed so that the total processing time might be reduced to 30 seconds.

TABLE 9

| Processing System | Photosensitive Material | Sensitivity | Point Gamma at D = 0.7–1.5 | Point Gamma at D = 2.0–2.8 | Color Stain* | Coverage of Dye (mg/m²) |
|---|---|---|---|---|---|---|
| I | 8 | 90 | 2.1–2.7 | 1.4–1.8 | A | 25 |
| (90 seconds' | 11 | 105 | 2.1–2.7 | 1.4–1.8 | A | 0 |

TABLE 9-continued

| Processing System | Photo-sensitive Material | Sensi-tivity | Point Gamma at D = 0.7–1.5 | Point Gamma at D = 2.0–2.8 | Color Stain* | Coverage of Dye (mg/m²) |
|---|---|---|---|---|---|---|
| processing) | 12 | 87 | 2.1–2.7 | 1.4–1.8 | A | 40 |
| II | 8 | 88 | 2.0–2.65 | 1.4–1.7 | A | 25 |
| (45 seconds' | 11 | 102 | 2.0–2.65 | 1.4–1.7 | A | 0 |
| processing) | 12 | 85 | 2.0–2.65 | 1.4–1.7 | A | 40 |
| III | 8 | 85 | 1.9–2.6 | 1.3–1.6 | A | 25 |
| (30 seconds' | 11 | 99 | 1.9–2.6 | 1.3–1.6 | A | 0 |
| processing) | 12 | 83 | 1.9–2.6 | 1.3–1.6 | Az | 40 |

*A: no color stain.
Az: slight color stain, but no problem in practical use.

As can be seen from Table 9, almost the same photographic characteristics as obtained in 90 seconds' processing were achieved in not only 45 seconds' processing but also 30 seconds' processing. As for the color stain in the film, on the other hand, there was no problem from the practical point of view even when Sample Nos. 8 and 12, which contained a dye in the support, were used as photosensitive material and the rapid processing, namely 45 seconds' processing and 30 seconds' processing, was carried out.

What is claimed is:

1. A method of forming radiation images comprising the steps of:

exposing a radiation image-forming system to radiation, said radiation image-forming system comprising a silver halide photographic material having at least one light-sensitive silver halide emulsion layer on each side of a transparent support and two radiation-intensifying screens respectively arranged on the front and the back sides of said photographic material, said photographic material having a crossover rate of at most 15% with respect to the light emitted from said intensifying screens; and developing said exposed photographic material to form a radiation image, wherein said developed photographic material has a characteristic curve such that when drawn using crossed coordinates equal to each other in unit length, with diffusion density as ordinate (Y-axis) and common logarithm of exposure amount as abscissa (X-axis), the characteristic curve provides a point gamma value ranging from 1.8 to 3.0 at every point within the optical density range of 0.7 to 1.5 and a point gamma value ranging from 1.2 to 2.0 at every point within the optical density range of 2.0 to 2.8.

2. The method of forming radiation images of claim 1, wherein said radiation-intensifying screens are comprised of a support and a phosphor layer formed on one side of said support.

3. The method of forming radiation images of claim 2, wherein the phosphor used in said phosphor layer is represented by the following general formula:

$$M_{(w-n)}M'_nO_wX$$

wherein M represents at least one metal selected from the group consisting of yttrium, lanthanum, gadolinium and lutetium; M' represents at least one rare earth element; X represents an intermediate chalcogen or a halogen; n is a numerical value ranging from 0.0002 to 0.2; and w is 1 when X is a halogen, while w is 2 when X is a chalcogen.

4. The method of forming radiation images of claim 3, wherein said phosphor is selected from the group consisting of terbium-activated rare earth metal oxysulfide phosphors, terbium-activated rare earth element oxyhalogenide phosphors and thulium-activated rare earth element oxyhalogenide phosphors.

5. A radiation image-formation system comprising a silver halide photographic material which has at least one light-sensitive silver halide emulsion layer on each side of a transparent support and two radiation-intensifying screens respectively arranged on the front and the back sides of the photographic material; said photographic material having a crossover rate of at most 15% with respect to the light emitted from said intensifying screens; and when sandwiched between said two intensifying screens, subjected to exposure to the same quantity of a monochromatic light having the same wavelength as that of the main emission peak of the radiation-intensifying screens and a half-width of 20±5 nm, through a step-wedge, and then developed with Developer (I) having the following composition at a developer temperature of 35° C. for a development time of 25 seconds, said photographic material producing an image having a characteristic curve such that when drawn using crossed coordinates equal to each other in unit length, with diffusion density as ordinate (Y-axis) and common logarithm of exposure amount as abscissa (X-axis), the characteristic curve provides a point gamma value ranging from 1.8 to 3.0 at every point within the optical density range of 0.7 to 1.5 and a point gamma value ranging from 1.2 to 2.0 at every point within the optical density range of 2.0 to 2.8:

| Composition of Developer (I) | |
|---|---|
| Potassium hydroxide | 21 g |
| Potassium sulfite | 63 g |
| Boric acid | 10 g |
| Hydroquinone | 25 g |
| Triethylene glycol | 20 g |
| 5-Nitroindazole | 0.2 g |
| Glacial acetic acid | 10 g |
| 1-Phenyl-3-pyrazolidone | 1.2 g |
| 5-Methylbenzotriazole | 0.05 g |
| Glutaraldehyde | 5 g |
| Potassium bromide | 4 g |
| Water to make | 1 l |
| pH adjusted to | 10.02. |

6. The radiation image-formation system of claim 5, wherein at least one dye layer having a thickness of 0.5 μm or less which enables reduction of crossover is provided between the silver halide emulsion layer and the support.

7. The radiation image-formation system of claim 5, wherein at least two kinds of silver halide emulsions constitute the light-sensitive silver halide emulsion layers and the ratio between the sensitivity of the silver halide emulsion having the lowest sensitivity and the sensitivity of at least one among other emulsions is in the range of 0.1:1 to 0.4:1.

8. The radiation image-formation system of claim 5, wherein the light-sensitive emulsion layer arranged at least on either front or back side of the support has sensitivity requiring an exposure amount ranging from 0.010 lux.sec to 0.035 lux.sec to provide the density of minimum density plus 0.5 for said layer when the photographic material is exposed to monochromatic light having the same wavelength as that of the main emission peak of the radiation-intensifying screens and a half-width of 20±5 nm, and developed with Developer (I) under a condition that a developer temperature is regulated at 35° C. and a development time is set at 25 seconds, and examined for the image density after the light-sensitive layer disposed on the opposite side is removed.

9. A method of forming radiation images using the silver halide photographic material claimed in claim 8 and sandwiching said material between two sheets of radiation-intensifying screens at least one of which has at least 25% of absorption with respect to X rays having an energy of 80 KVp and contrast transfer function (CTF) values of at least 0.79 at the spacial frequency of 1 cycle/mm and at least 0.36 at the spacial frequency of 3 cycles/mm.

10. A method of processing the silver halide photographic material of claim 5 with a roller conveyance type automatic developing machine wherein the total processing time is within the range of 30 seconds to 90 seconds.

11. The radiation image-formation system of claim 5, wherein said radiation-intensifying screens are comprised of a support and a phosphor layer formed on one side of said support.

12. The radiation image-formation system of claim 11, wherein the phosphor used in said phosphor layer is represented by the following general formula:

$$M_{(w-n)}M'_nO_wX$$

wherein M represents at least one metal selected from the group consisting of yttrium, lanthanum, gadolinium and lutetium; M' represents at least one rare earth element; X represents an intermediate chalcogen or a halogen; n is a numerical value ranging from 0.0002 to 0.2; and w is 1 when X is a halogen, while w is 2 when X is a chalcogen.

13. The radiation image-formation system of claim 12, wherein said phosphor is selected from the group consisting of terbium-activated rare earth metal oxysulfide phosphors, terbium-activated rare earth element oxyhalogenide phosphors and thulium-activated rare earth element oxyhalogenide phosphors.

* * * * *